US008944714B2

(12) United States Patent
Gueret

(10) Patent No.: US 8,944,714 B2
(45) Date of Patent: Feb. 3, 2015

(54) APPLICATOR FOR COMBING THE EYELASHES AND/OR EYEBROWS OR FOR APPLYING A COMPOSITION THERETO

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 528 days.

(21) Appl. No.: 12/739,356

(22) PCT Filed: Oct. 23, 2008

(86) PCT No.: PCT/IB2008/054379
§ 371 (c)(1),
(2), (4) Date: Aug. 16, 2010

(87) PCT Pub. No.: WO2009/053925
PCT Pub. Date: Apr. 30, 2009

(65) Prior Publication Data

US 2010/0310295 A1 Dec. 9, 2010

Related U.S. Application Data

(60) Provisional application No. 60/985,092, filed on Nov. 2, 2007, provisional application No. 61/102,632, filed on Oct. 3, 2008.

(30) Foreign Application Priority Data

Oct. 23, 2007 (FR) ..... 07 58530
Nov. 16, 2007 (FR) ..... 07 59109

(51) Int. Cl.
*A46B 11/00* (2006.01)
*A45D 40/26* (2006.01)
*A46B 9/02* (2006.01)

(52) U.S. Cl.
CPC ..... *A45D 40/267* (2013.01); *A46B 9/021* (2013.01); *A46B 9/028* (2013.01); *A46B 2200/1053* (2013.01); *A46B 2200/106* (2013.01)
USPC ..... 401/129; 401/126

(58) Field of Classification Search
CPC ..... A46B 9/021; A46B 9/028
USPC ..... 401/126–129; 132/218
See application file for complete search history.

(56) References Cited

U.S. PATENT DOCUMENTS 3,998,232 A 12/1976 Smith
4,403,624 A * 9/1983 Montgomery ..... 132/218

(Continued)

FOREIGN PATENT DOCUMENTS

DE 25 59 273 A1 7/1977
DE 199 11 763 A1 9/2000

(Continued)

OTHER PUBLICATIONS http:www.calce.umd.edu/TSFA/Hardness_ad_.htm.

(Continued)

*Primary Examiner* — David Walczak
*Assistant Examiner* — Jennifer C Chiang
(74) *Attorney, Agent, or Firm* — Oliff PLC

(57) ABSTRACT

An applicator for combing and/or for applying a composition including a molded applicator member, that includes an elongate core extending along a longitudinal axis; and at least three rows of teeth connected to the core, the rows extending along the longitudinal axis of the core, having at least one row of long teeth and at least one row of short teeth, the implantation of the rows of teeth being substantially constant around the core over at least a fraction of the length of the applicator member, at least one row of long teeth is disposed on the core in a manner that is different from a row of short teeth, the two rows differing in at least one of the following ways: the spacing of the teeth in the row; the number of teeth in the row; or the thickness of the teeth measured perpendicularly to their long direction.

51 Claims, 10 Drawing Sheets

(56) References Cited

U.S. PATENT DOCUMENTS

| | | | | |
|---|---|---|---|---|
| 4,561,456 | A | 12/1985 | Gueret | |
| 4,565,205 | A | 1/1986 | Taylor | |
| 4,635,659 | A | 1/1987 | Spatz | |
| 4,660,582 | A * | 4/1987 | Taylor | 132/218 |
| 4,810,122 | A | 3/1989 | Cole | |
| 4,898,193 | A | 2/1990 | Gueret | |
| 4,964,429 | A | 10/1990 | Cole | |
| 6,260,558 | B1 | 7/2001 | Neuner | |
| 6,328,495 | B1 | 12/2001 | Gueret | |
| 6,343,607 | B1 * | 2/2002 | Gueret | 132/218 |
| 6,375,374 | B2 | 4/2002 | Gueret | |
| 6,408,857 | B1 | 6/2002 | Neuner | |
| 6,412,496 | B1 | 7/2002 | Gueret | |
| 6,494,215 | B2 | 12/2002 | Gueret | |
| 6,539,950 | B1 | 4/2003 | Gueret | |
| 6,581,610 | B1 | 6/2003 | Gueret | |
| RE38,230 | E | 8/2003 | Gueret | |
| 6,616,366 | B1 | 9/2003 | Weihrauch | |
| 6,669,389 | B2 * | 12/2003 | Gueret | 401/122 |
| 6,681,777 | B2 | 1/2004 | Gueret | |
| 7,171,969 | B2 | 2/2007 | Gueret | |
| 7,231,926 | B2 | 6/2007 | Kim | |
| 7,254,860 | B2 | 8/2007 | Dumler et al. | |
| 7,261,483 | B2 | 8/2007 | Gueret | |
| 7,325,550 | B2 | 2/2008 | Eckers et al. | |
| D573,348 | S | 7/2008 | Dumler et al. | |
| 7,581,546 | B2 | 9/2009 | Dumler | |
| 7,581,898 | B2 | 9/2009 | Gueret | |
| 7,665,473 | B1 | 2/2010 | Gueret | |
| 7,686,528 | B2 | 3/2010 | Gueret | |
| 7,921,857 | B2 | 4/2011 | Gueret | |
| 7,946,778 | B2 | 5/2011 | Gueret | |
| 8,056,569 | B2 | 11/2011 | Berhault | |
| 8,096,306 | B2 * | 1/2012 | Malvar et al. | 132/218 |
| 8,100,138 | B2 | 1/2012 | Gueret | |
| 8,122,895 | B2 | 2/2012 | Gueret | |
| 8,127,777 | B2 | 3/2012 | Gueret | |
| 2001/0037815 | A1 | 11/2001 | Gueret | |
| 2002/0023657 | A1 | 2/2002 | Gueret | |
| 2002/0023658 | A1 * | 2/2002 | Gueret | 132/218 |
| 2003/0213498 | A1 | 11/2003 | Gueret | |
| 2004/0221865 | A1 | 11/2004 | Kim | |
| 2004/0244808 | A1 | 12/2004 | Mathiez | |
| 2004/0258453 | A1 | 12/2004 | Gueret | |
| 2005/0028834 | A1 | 2/2005 | Ramet | |
| 2005/0034740 | A1 | 2/2005 | Eckers et al. | |
| 2005/0081874 | A1 * | 4/2005 | Mathiez | 132/218 |
| 2005/0175394 | A1 | 8/2005 | Gueret | |
| 2005/0258569 | A1 | 11/2005 | Schoemann et al. | |
| 2006/0056903 | A1 | 3/2006 | Gueret | |
| 2006/0070635 | A1 | 4/2006 | Dumier et al. | |
| 2006/0093425 | A1 | 5/2006 | Gueret | |
| 2006/0272666 | A1 | 12/2006 | Wyatt et al. | |
| 2007/0033759 | A1 | 2/2007 | Dumler | |
| 2007/0033760 | A1 | 2/2007 | Dumler | |
| 2007/0079845 | A1 | 4/2007 | Gueret | |
| 2008/0011317 | A1 | 1/2008 | Malvar et al. | |
| 2008/0023020 | A1 | 1/2008 | Gueret | |
| 2008/0115798 | A1 * | 5/2008 | Rainey et al. | 132/218 |
| 2008/0245382 | A1 | 10/2008 | Marciniak-Davoult et al. | |
| 2008/0251093 | A1 | 10/2008 | Gueret | |
| 2008/0283077 | A1 | 11/2008 | Gueret | |
| 2009/0065018 | A1 | 3/2009 | Berhault | |
| 2009/0114239 | A1 | 5/2009 | Chen | |
| 2009/0193602 | A1 | 8/2009 | Dumler et al. | |
| 2010/0060161 | A1 | 3/2010 | Büehler et al. | |
| 2010/0175708 | A1 | 7/2010 | Kim | |

FOREIGN PATENT DOCUMENTS

| | | | |
|---|---|---|---|
| DE | 101 02 219 | A1 | 7/2002 |
| DE | 20 2007 008 147 | U1 | 11/2007 |
| EP | 1 161 896 | A1 | 12/2001 |
| EP | 1 188 393 | B1 | 3/2002 |
| EP | 1 236 419 | B1 | 9/2002 |
| EP | 1 342 428 | A1 | 9/2003 |
| EP | 1 344 470 | B1 | 9/2003 |
| EP | 1 358 818 | B1 | 11/2003 |
| EP | 1 584 260 | B1 | 10/2005 |
| EP | 1 602 300 | B1 | 12/2005 |
| EP | 1 611 817 | A1 | 1/2006 |
| EP | 1 632 149 | B1 | 3/2006 |
| EP | 1 649 777 | A2 | 4/2006 |
| EP | 1 665 952 | A2 | 6/2006 |
| EP | 1 752 066 | B1 | 2/2007 |
| EP | 1 752 067 | B1 | 2/2007 |
| EP | 1 872 682 | A1 | 1/2008 |
| EP | 1 977 662 | A1 | 10/2008 |
| FR | 2 505 633 | | 11/1982 |
| FR | 2 564 712 | A1 | 11/1985 |
| FR | 2 605 505 | A1 | 4/1988 |
| FR | 2 891 709 | A1 | 4/2007 |
| FR | 2 897 762 | A1 | 8/2007 |
| FR | 2 906 115 | | 3/2008 |
| GB | 2 071 558 | A | 9/1981 |
| GB | 2 159 699 | A | 12/1985 |
| JP | A-2007-117602 | | 5/2007 |
| WO | WO 95/17837 | | 7/1995 |
| WO | WO 01/05273 | A1 | 1/2001 |
| WO | WO 01/05274 | A1 | 1/2001 |
| WO | WO 02/056726 | A2 | 7/2002 |
| WO | WO 2006/090343 | A1 | 8/2006 |
| WO | WO 2006/124228 | A1 | 11/2006 |
| WO | WO 2006/125122 | A1 | 11/2006 |

OTHER PUBLICATIONS

Office Action issued Jan. 19, 2012 in U.S. Appl. No. 12/739,398.

Office Action issued Feb. 2, 2012 in U.S. Appl. No. 12/739,363.

Office Action issued Jul. 11, 2012 in U.S. Appl. No. 12/739,363.

Office Action issued Aug. 10, 2011 in Chinese Patent Application No. 200880112706.X.

International Search Report for PCT/IB2008/054379, dated Apr. 7, 2009.

Copending U.S. Appl. No. 12/739,338, filed Apr. 22, 2010.

Copending U.S. Appl. No. 12/739,363, filed Apr. 22, 2010.

Copending U.S. Appl. No. 12/739,398, filed Apr. 22, 2010.

English language Abstract of DE 25 59 273 A1, dated Jul. 7, 1977.

English language abstract of EP 1 602 300 B1, dated Dec. 7, 2005.

English language Abstract of EP 1 665 952 A2, dated Jun. 7, 2006.

English language abstract of EP 1 752 067 B1, dated Feb. 14, 2007.

English language abstract of FR 2 891 709 A1, dated Apr. 13, 2007.

English language abstract of FR 2 897 762 A1, dated Aug. 31, 2007.

International Search Report for PCT/IB2008/054375, dated Apr. 8, 2009.

International Search Report for PCT/IB2008/054380, dated Apr. 21, 2009.

International Search Report for PCT/IB2008/054383, dated Feb. 11, 2009.

Oct. 17, 2012 Office Action issued in U.S. Appl. No. 12/739,398.

U.S. Office Action dated Jan. 7, 2013 from U.S. Appl. No. 12/739,338.

U.S. Office Action dated Aug. 20, 2013 from U.S. Appl. No. 12/739,338.

U.S. Office Action dated Jun. 10, 2013 from U.S. Appl. No. 12/739,398.

"Hytrel® . . . A thermoplastic and elastomer in one;" Dupont™ Hytrel® TPC-ET thermoplastic polyester elastomer; http://www2.dupont.com/Plastics/en_US/Products/Hytrel/Hytrel.html.

"Hardness Scale—Durometer Comparisons of Materials;" Plastics International; http://www.plasticsintl.com/polyhardness.htm.

Campo, Alfred; "Selection of Polymeric Materials;" Norwich; 2008; pp. 19; William Andrew Inc.

U.S. Office Action dated Mar. 1, 2013 from U.S. Appl. No. 12/739,363.

U.S. Office Action dated Oct. 10, 2013 from U.S. Appl. No. 12/739,363.

(56) References Cited

OTHER PUBLICATIONS

Third Party Submission dated Mar. 31, 2014 submitted in European Patent Application No. 08842187.0 (corresponding to U.S. Appl. No. 12/739,363).

"Guide to Overmolding With Melt Processible Elastomers (MPEs);" *Advanced Polymer Alloys*; Nov. 29, 2006; pp. 1-10.

Third Party Submission dated Apr. 2, 2014 submitted in European Patent Application No. 08841710.0 (corresponding to U.S. Appl. No. 12/739,356).

Third Party Submission dated May 2, 2014 submitted in European Patent Application No. 08841950.2 (corresponding to U.S. Appl. No. 12/739,398).

Third Party Submission dated May 2, 2014 submitted in European Patent Application No. 08841542.7 (corresponding to U.S. Appl. No. 12/739,338).

U.S. Office Action dated Mar. 28, 2014 from U.S. Appl. No. 12/739,363.

* cited by examiner

Fig.5
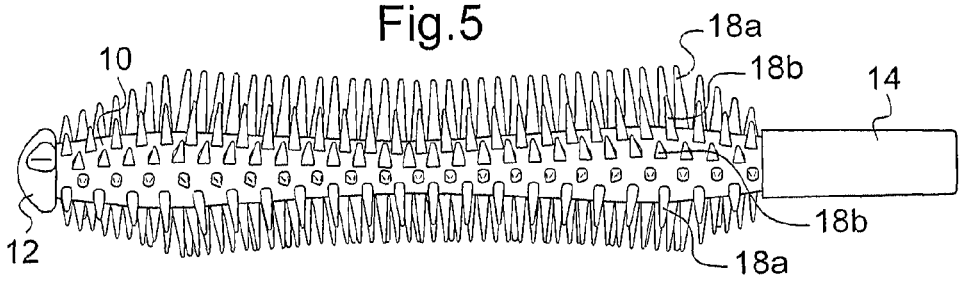
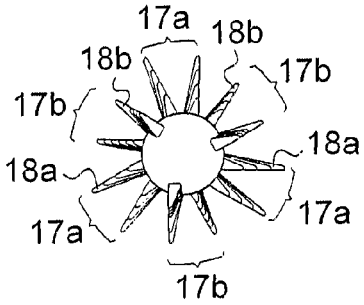
Fig.6
Fig.7
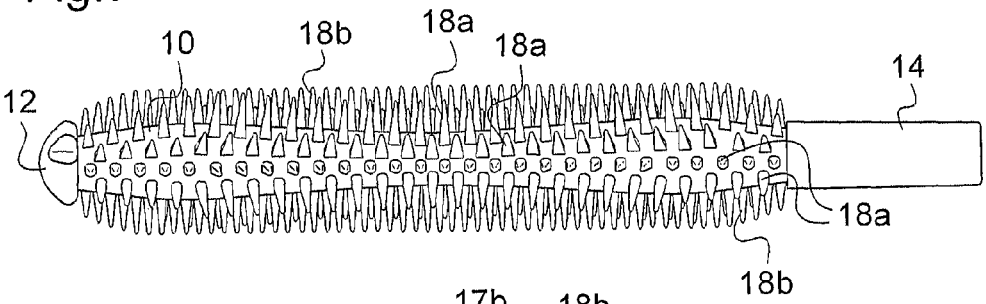
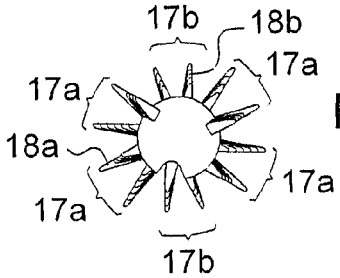
Fig.8
Fig.9
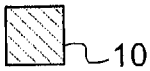
Fig.10a
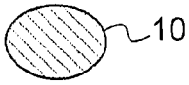
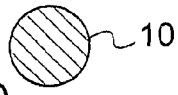
Fig.10
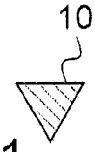
Fig.11
Fig.13
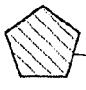
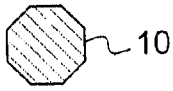
Fig.12

Fig.14
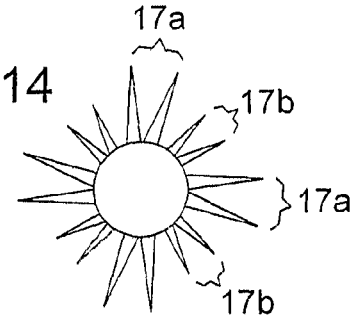
Fig.15
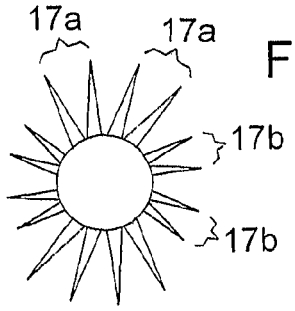
Fig.16
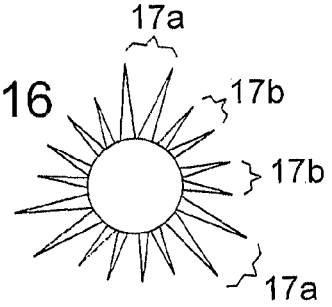
Fig.16a
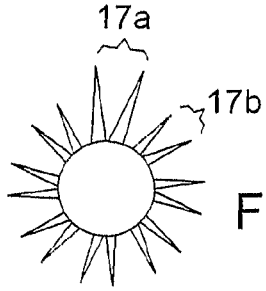
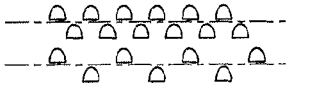
Fig.17
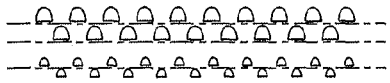
Fig.18
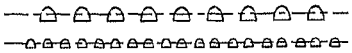
Fig.19
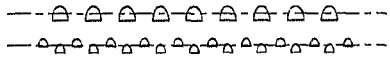
Fig.20
Fig.20a
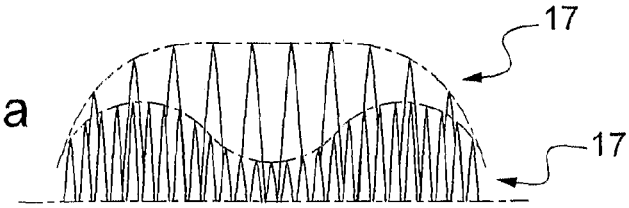
Fig.20b
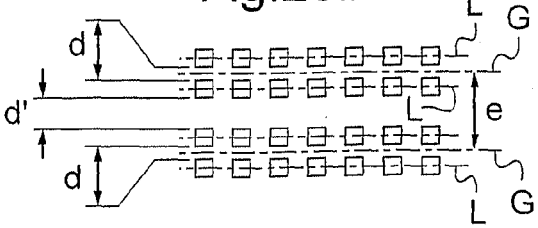
Fig.20c
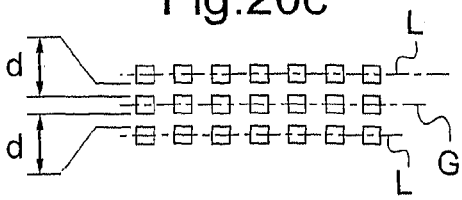

Fig.21
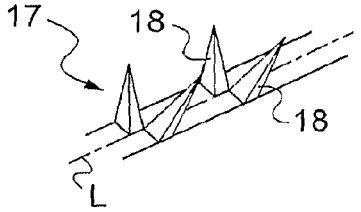
Fig.21a
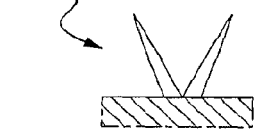
Fig.20d
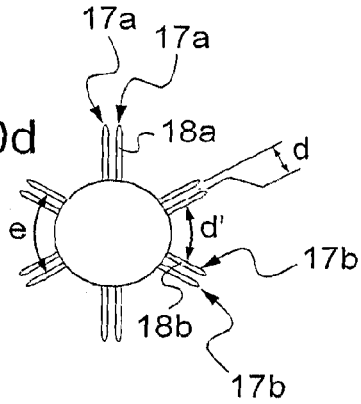
Fig.21b
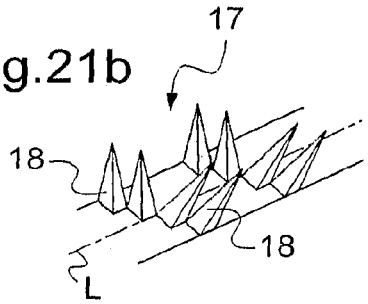
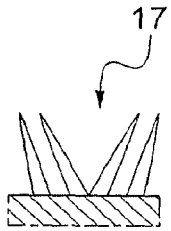
Fig.21c
Fig.21d
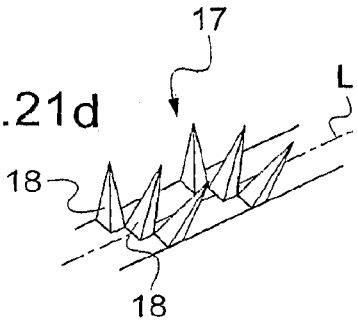
Fig.21e
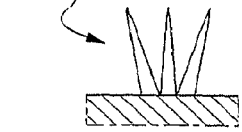
Fig.22
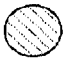
Fig.24
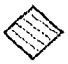
Fig.26
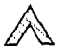
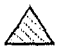
Fig.23
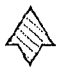
Fig.25

Fig.27
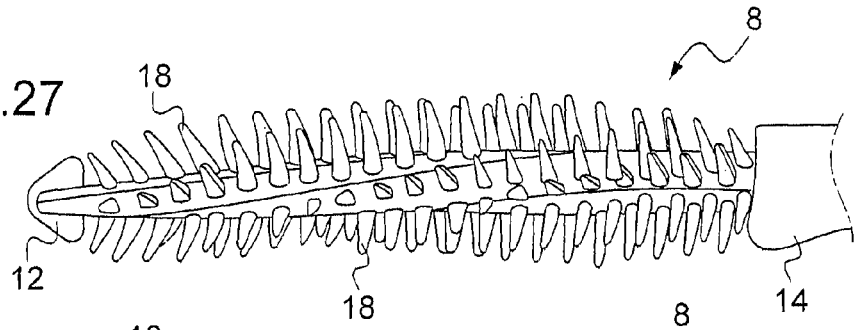
Fig.28
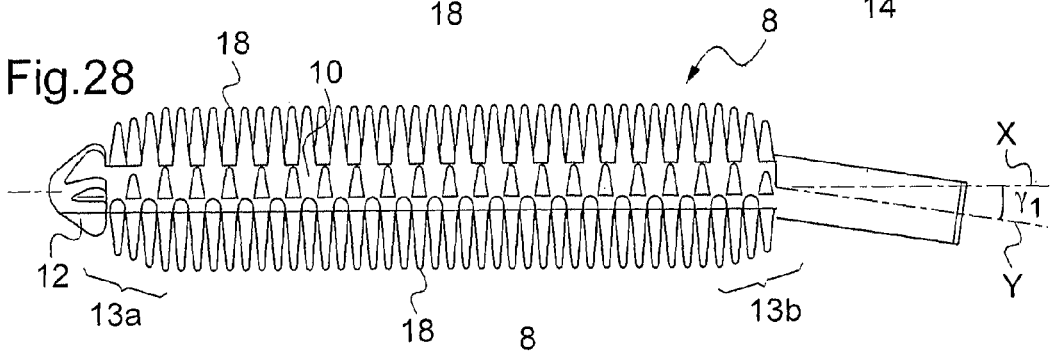
Fig.29
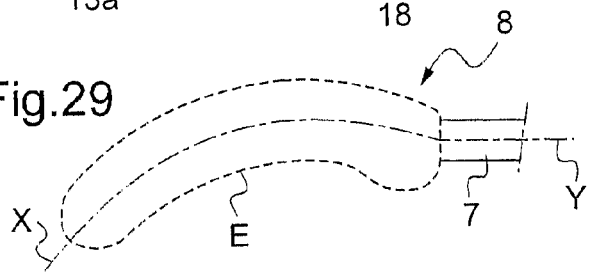
Fig.30
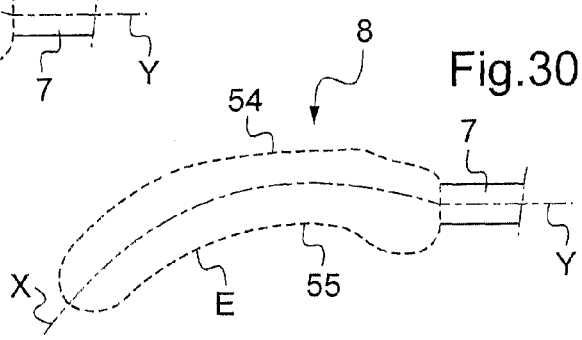
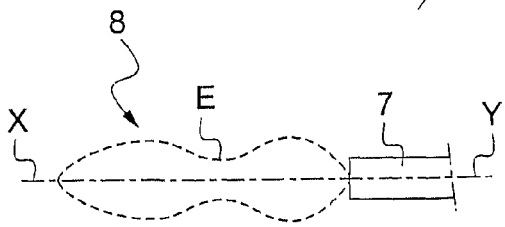
Fig.31
Fig.32
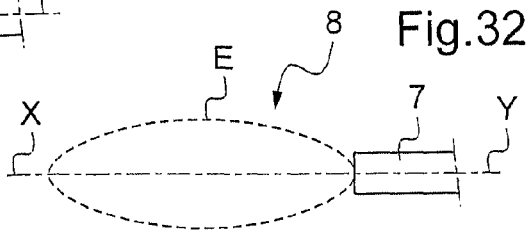
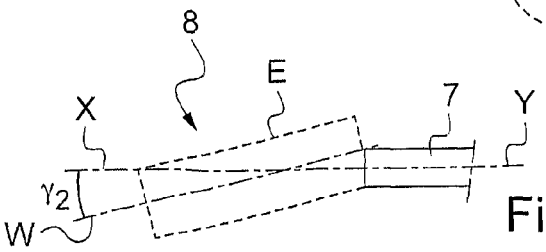
Fig.33

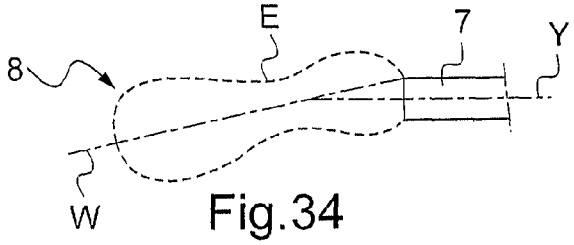
Fig.34
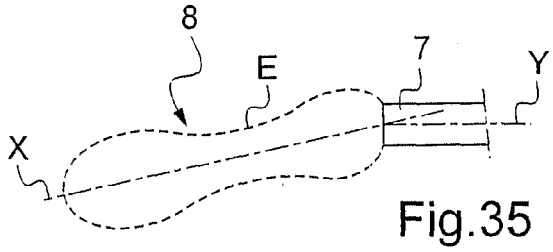
Fig.35
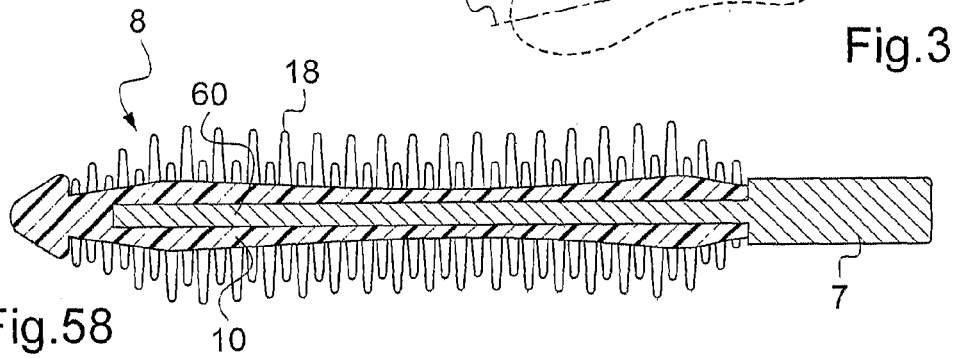
Fig.58
Fig.59
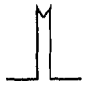
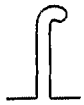
Fig.60
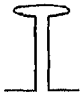
Fig.61
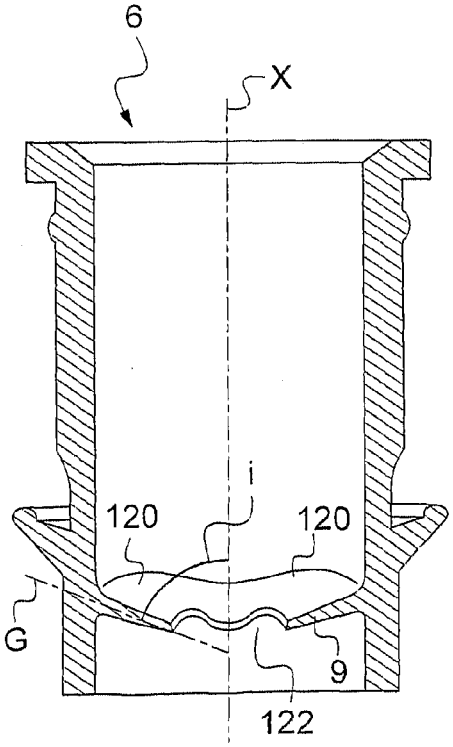
Fig.62
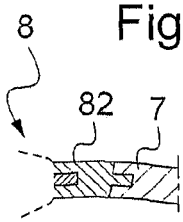
Fig.63
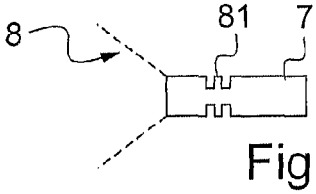
Fig.64

APPLICATOR FOR COMBING THE EYELASHES AND/OR EYEBROWS OR FOR APPLYING A COMPOSITION THERETO

This application is a national phase application of International Patent Application No. PCT/IB2008/054379, filed Oct. 23, 2008, and claims the right to priority under 35 U.S.C. §119 based on French Patent Application No. 07 58530, filed Oct. 23, 2007, claims the right to priority under 35 U.S.C. §119(e) based on U.S. Provisional Application No. 60/985,092, filed Nov. 2, 2007, claims the right to priority under 35 U.S.C. §119 based on French Patent Application No. 07 59109, filed Nov. 16, 2007, and claims the right to priority under 35 U.S.C. §119(e) based on U.S. Provisional Application No. 61/102,632, filed Oct. 3, 2008, the contents of all of which are incorporated herein by reference in their entirety.

The present invention relates to an applicator for combing keratinous fibers, in particular the eyelashes and/or the eyebrows, and/or for applying a cosmetic, makeup, or a care product, e.g. mascara, thereto.

The invention also relates to a packaging device comprising such an applicator.

The invention also relates to a cosmetic treatment.

Patent application GB 2 071 558 discloses a mascara applicator comprising teeth that extend from a central core in directions that are different, the teeth being disposed regularly over the support, with spacing that is constant.

U.S. Pat. No. 4,565,205 discloses a mascara comb comprising teeth of lengths that are different, and extending from a central support in directions that are parallel to one another.

U.S. publication 2007/0033759 describes an applicator having long teeth that are all parallel to one another.

U.S. Pat. No. 4,635,659 discloses an applicator comprising rows of teeth having the same number of teeth, with regular spacing between the teeth and the teeth presenting the same thickness.

European application EP 1 872 682 describes an applicator in which the implantation of the teeth in the row varies. The applicator does not comprise rows of short teeth or long teeth.

EP 0 075 051 describes a mould for mascara applicator, the applicator comprising rows of the same number of teeth, with regular spacing between the teeth and the teeth presenting the same thickness. EP 1 611 817, WO 2006/124228, WO 2006/0070635 and DE 20 2007 008147 describe applicators comprising rows of teeth with different length of teeth. The invention seeks to improve still further applicators for applying a composition to the eyelashes and/or the eyebrows, in particular in terms of the ability of the teeth to penetrate into the eyelashes, to smooth the composition on the eyelashes, and to separate said eyelashes.

The invention also seeks to enable the user to achieve various makeup effects depending on her needs.

In exemplary embodiments, the invention provides an applicator for combing the eyelashes and/or the eyebrows and/or for applying a composition thereto, the applicator comprising a molded applicator member, comprising:

an elongate core that extends along a longitudinal axis; and at least three rows of teeth that are connected to the core, the rows extending along the longitudinal axis of the core, having at least one row of long teeth and at least one row of short teeth, the implantation of the rows of teeth on the core being substantially constant around the core over at least a fraction of the length of the applicator member, wherein at least one row of long teeth is disposed on the core in a manner that is different from a row of short teeth, the two rows differing in at least one of the following features: the spacing of the teeth in the row; the number of teeth in the row; the thickness of the teeth measured perpendicularly to their long direction.

In exemplary embodiments, the invention provides an applicator for combing the eyelashes and/or the eyebrows and/or for applying a composition thereto, the applicator comprising a molded applicator member, comprising:

an elongate core that extends along a longitudinal axis; and at least three rows of teeth that are connected to the core, the rows extending along the longitudinal axis of the core, having at least one row of long teeth and at least one row of short teeth, with rows of teeth being disposed in at least one group of close-together rows, the implantation of the groups of close-together rows on the core being substantially constant around the core over at least a fraction of the length of the applicator member, and the teeth of the group of close-together rows being parallel to one another within the group In exemplary embodiments, the invention provides an applicator for combing the eyelashes and/or the eyebrows and/or for applying a composition thereto, the applicator comprising a molded applicator member, comprising:

an elongate core that extends along a longitudinal axis; and at least three rows of teeth that are connected to the core, the rows extending along the longitudinal axis of the core, having at least one row of long teeth and at least one row of short teeth, the implantation of the rows of teeth, or of groups of close-together rows, on the core being substantially constant around the core over at least a fraction of the length of the applicator member.

The applicator of the invention offers new makeup possibilities and may contribute to improve still further the quality of the makeup effect. The applicator of the invention may be made easily by molding, while offering performance that is advantageous.

The term "row" is used to designate a succession of teeth that are situated on the same side of the core, and that succeed one another along the core.

The applicator may comprise at least three rows of teeth extending along the longitudinal axis, e.g. between 3 and 20 rows of teeth, better between 4 and 18 rows, better still between 6 and 10 rows.

A row of teeth extending along the longitudinal axis may have at least three teeth of the same length.

Within a row of teeth, the number of teeth may lie in the range about 6 to 60, in particular in the range about 10 to 50.

At least one row of teeth may extend along a rectilinear axis that may optionally be parallel to the longitudinal axis of the core.

At least two teeth of at least one row may present lengths that are different or identical.

The presence of long teeth and of short teeth makes it possible to coat and to separate the eyelashes.

The term "longitudinal axis" of the core should be understood as the line that joins the centers of gravity (barycenters) of the cross-sections of the core. In some circumstances, the longitudinal axis may be a central axis, or even an axis of symmetry for the core, in particular when the core presents a cross-section that has the general shape of a regular polygon or a circle. The longitudinal axis may be rectilinear or curved.

The term "tooth" is used to designate an element that projects individually, the term being synonymous with "bristle" in the context of the present invention.

In the absence of groups of close-together rows, the term "substantially constant implantation on the core" is used to mean that the rows of teeth, whether they be formed of long or short teeth, are distributed on the core around the longitudinal axis of said core in substantially regular manner, with substantially constant angular spacing between the longitudinal axes of the rows, measured over the surface of the core.

When the applicator member comprises only groups of close-together rows of teeth, the term "substantially constant implantation" should be understood to mean that the longitudinal axes of the groups of rows are disposed around the core with substantially constant spacing, measured along the surface of the core.

The term "substantially constant spacing" should be understood to mean a distance e that is constant to within 20% (i.e. e±20%), better to within 10%, better still to within 5%, or even to within 2%). For some core shapes, in particular core shapes having a cross-section that is circular or in the shape of a regular polygon, the substantially constant spacing at the surface of the core may be accompanied by substantially constant angular spacing around the longitudinal axis of the core.

In the presence of both isolated rows and groups of close-together rows, the spacing is measured along the surface of the core between the longitudinal axes of the isolated rows and the longitudinal axes of the groups of close-together rows.

A group of close-together rows comprises a plurality of rows, e.g. two, three, or four, a tooth of one row of the group being separated from the closest tooth of an adjacent row of the group by a distance that is less than 0.8 millimeters (mm), better less than 0.6 mm, better still less than 0.4 mm, e.g. by a distance that is less than the thickness of the teeth, e.g. a distance lying in the range 0.2 mm to 0.8 mm, or even in the range 0.3 mm to 0.6 mm.

The rows of a group of close-together rows are preferably parallel to one another.

The teeth of a group of close-together rows, better of each group of close-together rows, may be parallel to one another within the group.

Apart from the teeth of a single group of close-together rows, the applicator member may not have any teeth extending parallel to one another away from the core.

At least one row of long teeth may be disposed on the core in a manner that is different from a row of short teeth, the two rows differing in at least one of the following ways: the spacing of the teeth in the row; the number of teeth in the row; the thickness of the teeth measured perpendicularly to their long direction.

The teeth of the rows of a group of close-together rows may have the same axial positions along the longitudinal axis of the core.

The longitudinal axis of a group of close-together rows is the middle axis for the group. For example, for a group of two close-together rows, the longitudinal axis of the group is the axis that is situated mid-way between the longitudinal axes of the rows of the group.

The applicator member may comprise at least two rows of teeth, the teeth of one of the rows not being parallel to the teeth of the other row.

At least five teeth belonging to the rows of long teeth may extend from the core in different directions.

A large number of teeth extending in different directions makes it possible to have an applicator member that does not require prior identification of position by the user during application.

When observed in cross-section, the envelope surface of the applicator member may be non-circular, and when turned about the core, it may alternate between a distance from the core that is greater than a mean radius and a distance from the core that is less than the mean radius, and vice versa, for example. By way of example, the teeth may define two concentric surfaces, one having a radius that is less than the mean radius, and the other having a radius that is greater than the mean radius. The fact that the free ends of the teeth are not all situated at the same distance from the longitudinal axis can improve the ability of the teeth to penetrate into the eyelashes, in particular while the applicator is being turned relative to the eyelashes during application.

The term "short teeth" is used to mean the teeth of the applicator member having a length that is strictly less than a threshold length, and the term "long teeth" is used to mean the teeth of the applicator member having a length that is strictly greater than the same threshold length. By way of example, the threshold length may be an average length of a majority, or even of all, of the teeth of the applicator member. A row of short teeth comprises a majority of short teeth, and in the limit all of the teeth of the row may be short teeth. A row of long teeth comprises a majority of long teeth, and in the limit all of the teeth of the row may be long teeth.

The applicator member may comprise one or more rows of short teeth, and one or more rows of long teeth. The presence of rows of long teeth makes it possible, where appropriate, to ovalize the cross-section of the envelope surface or bring it close to a polygon.

The applicator member may comprise a plurality of rows of long teeth and a plurality of rows of short teeth. The rows of long teeth may alternate with the rows of short teeth.

By way of example, the number of rows of short teeth may be greater than the number of rows of long teeth. The number of short teeth may be greater than the number of long teeth.

More than half of the teeth of the applicator member may belong to the rows of short teeth. In a variant, fewer than half of the teeth of the applicator member may belong to the rows of short teeth.

The teeth of the rows of short teeth and the teeth of the rows of long teeth may be made out of the same material. In a variant, the teeth of the rows of short teeth and the teeth of the rows of long teeth may be made out of different materials. By way of example, the two materials may have mechanical properties that are different, in particular in terms of hardness or of flexibility, one of the materials being softer than the other, for example, or even having a color that is different, or even having a chemical nature that is different.

Independently or in combination with the above, the invention also provides an applicator for combing the eyelashes or the eyebrows and/or for applying a composition thereto, the applicator comprising a molded applicator member, comprising:

an elongate core that extends along a longitudinal axis; and at least three rows, better at least four rows, of teeth that are connected to the core, the rows of teeth extending along the longitudinal axis of the core, having at least one row of long teeth and at least one row of short teeth, the teeth, when observed along the longitudinal axis of the core, extending from the core in different directions to one another, at an angular spacing that is substantially constant, e.g. constant to within 20%, better to within 10%, still better to within 5%. By way of example, the angular spacing may be less than 60°, e.g. being about 45°. The angular spacing may be measured at the base of the teeth, between the directions of elongation of the teeth.

At least one row of long teeth may be disposed on the core in a manner that is different from a row of short teeth, the two rows differing in at least one of the following ways: the spacing of the teeth in the row; the orientation of the teeth in the row; the number of teeth in the row; the thickness of the teeth; the material forming the teeth; the shape of the teeth; the shape of the cross-section of the teeth. In a variant, the rows of long teeth and the rows of short teeth may differ from one another only in the length of the teeth.

The term "thickness of a tooth" is used to mean the greatest transverse dimension of the tooth, measured perpendicularly to its direction of elongation.

The teeth of the rows of short teeth may be spaced apart within the row at a first spacing, and the teeth of the rows of long teeth may be spaced apart at a second spacing, the first spacing being different from the second spacing, in particular being smaller. In a variant, it may be greater. The spacing is measured at the base of the teeth and corresponds to the gaps between the outside surfaces of the teeth.

The thickness of the teeth of the rows of short teeth at their bases and/or half-way up their heights, may be less than the thickness of the teeth of the rows of long teeth. In a variant, the thickness of the teeth of the rows of short teeth at their bases and/or half-way up their heights, may be greater than the thickness of the teeth of the rows of long teeth.

The majority of the teeth may have thickness lying either in the range 0.2 mm to 5 mm, better in the range 0.2 mm to 0.45 mm, or even in the range 0.2 mm to 0.39 mm, or else it may be strictly greater than 0.5 mm and less than 0.65 mm.

In the first instance, i.e. when the thickness lies in the range 0.2 mm to 0.5 mm, the teeth are relatively fine and may also be relatively flexible when the material from which they are made is a flexible material.

In the second instance, i.e. when the thickness lies in the range 0.5 mm to 0.65 mm, the teeth are thicker and may be more rigid. The thickness of the teeth could be selected as a function of the type of makeup effect desired and/or the nature of the eyelashes to be treated and/or the rheology of the composition, for example.

The applicator may comprise only teeth having thickness lying in the range 0.2 mm to 0.5 mm, or, in a variant, only teeth having thickness that is strictly greater than 0.5 mm and less than 0.65 mm, or it may even comprise both.

By way of example, teeth having a certain thickness may be mixed with teeth having another thickness, or, in a variant, teeth having a certain thickness may be grouped together in a first region of the applicator member, while teeth having another thickness are grouped together in a second region of the applicator member, e.g. opposite from the first portion.

The teeth of the rows of short teeth and the teeth of the rows of long teeth need not be disposed within their rows in the same manner relative to the core.

The rows of long teeth may be at least two in number, e.g. two diametrically opposite rows, better at least three in number, with two adjacent rows of long teeth thus being spaced apart angularly by no more than 120°.

The rows of long teeth may comprise at least two sets of rows of teeth, the rows of long teeth of a single set following one another around the longitudinal axis, and the two sets of rows of long teeth being separated around the longitudinal axis of the core by at least one row of short teeth.

A row of long teeth may follow a row of short teeth around the longitudinal axis of the core.

The teeth of the rows of long teeth may be connected to the core by occupying a first angular sector of the core, with the teeth of the rows of short teeth being connected to the core by occupying a second sector of the core, the angular extents of the first and second sectors being different, or, in a variant, being equal.

At least some of the teeth in the rows of short teeth, in particular a majority of the teeth or all of them, may have a length, measured from the core, that is less than 1.8 mm, better less than or equal to 1.75 mm. Such a length for the short teeth is adapted to users having eyelashes or eyebrow hairs that are relatively short. By way of example, the short teeth have a teeth lying in the range 0.5 mm to 1.8 mm, or even in the range 0.5 mm to 1.49 mm, e.g. in the range 0.5 mm to 0.99 mm.

The term "length of tooth" is used to designate the distance measured along the long direction of the tooth between the free end of the tooth and its base via which it is connected to the core. The length of a tooth is thus measured from the core of the applicator member.

More than half of the short teeth may have a length as defined above, or even at least 60%, 70%, or better 80% of the teeth.

More than half of the teeth of the applicator member may be short teeth.

At least some of the teeth in the rows of long teeth, in particular a majority of the teeth or all of them, may have a length, measured from the core, lying in the range 1.35 mm to 3.4 mm, for example, or even in the range 1.5 mm to 3 mm, better in the range 1.5 mm to 2.8 mm, better in the range 1.65 mm to 2.1 mm or even in the range 2.1 mm to 3 mm.

The teeth having a length as defined above may be situated at least in the central portion of the applicator member, for example.

The difference between the length of the short teeth and the length of the long teeth may lie in the range 0.3 mm to 1.2 mm, e.g. being at least 0.5 mm. By way of example, the difference corresponds to more than 20% of the length of the short teeth and to less than 50% of said length.

The difference in length between the long teeth and the short teeth need not be immediately noticeable to the user when the applicator member is impregnated with composition, thereby avoiding the user giving any consideration to the orientation to be given to the applicator member in order to treat the eyelashes.

The ends of the teeth of the rows of short teeth may define a first surface of greatest transverse dimension, e.g. a diameter, that is less than 5.5 mm.

The ends of the teeth of the rows of long teeth may define a second surface of greatest transverse dimension, e.g. a diameter, lying in the range 5.7 mm to 10 mm, or even strictly greater than 6 mm, e.g. about 6.5 mm to 7 mm.

The teeth of the rows of short teeth and of the rows of long teeth may be disposed on the core in such a manner as to enable the teeth of the rows of short teeth to come into contact with the eyelashes or the eyebrows during application.

The applicator may comprise between 150 and 500 teeth, for example.

At least two teeth of at least one row may present shapes that are different or identical.

At least one tooth of at least one row may present a general shape that tapers towards its free end.

At least one tooth may be of tapered, frustoconical, or pyramid shape.

At least one tooth of one of the rows may present a shape that is different from a tooth of another row.

When the core is observed along its longitudinal axis, two teeth of a row may extend at their bases in directions that form a first angle between them, and two teeth of another row may extend at their bases in directions that form a second angle between them, the first and second angles being equal or different.

Within each row, the teeth may be spaced-apart evenly along the longitudinal axis of the row, or they may be grouped together in groups of two or more teeth, the spacing between the teeth of one group along the longitudinal axis of the row being less than the spacing between two adjacent groups of teeth of said row.

By adapting the shape of the teeth and their spacing, it is possible to establish cavities of greater or smaller size between the teeth, such cavities being suitable for being loaded with composition.

At least two successive teeth of a row, e.g. a row of long teeth or a row of short teeth, may optionally be touching at their base, all of the teeth of the row respectively being non-touching or touching at their bases. The spacing between the teeth, measured at the bases of the teeth, may lie in the range 0 to 1.2 mm within a row, e.g. in the range 0.01 mm and 1 mm. When the teeth are touching at their base, the spacing between the teeth measured at the base of the teeth is zero.

When the applicator is observed in section perpendicularly to its longitudinal axis, at least two consecutive teeth of a row may define a V-shaped groove. The same applies when the applicator is observed along the longitudinal axis of the applicator member.

Teeth of one row and teeth of another row may extend in different directions.

The teeth of a row may have bases that are substantially in alignment, i.e. the centers of the bases of three consecutive teeth are situated substantially on a single straight line.

The core may comprise a plurality of longitudinal faces, and the applicator may comprise rows of teeth, each extending from one of the longitudinal faces of the core.

The teeth of at least one row may be connected to the corresponding longitudinal face of the core on the same side of a middle longitudinal line of the longitudinal face of the core.

The teeth may have bases that are not centered on the longitudinal face of the core to which they are connected.

The bases of the teeth in a row may be in alignment, or they may be disposed in a staggered configuration. For a staggered configuration, a plurality of consecutive teeth of the row may be offset at least in part, alternately on opposite sides of a geometrical separation surface, the surface possibly being a plane, in particular a mid-plane for the row.

The consecutive teeth may be offset completely, alternately on opposite sides of the geometrical separation surface. The term "offset completely" should be understood as the geometrical separation surface not passing through the teeth, being a tangent to said teeth at the closest.

All of the teeth of each row may be offset alternately on opposite sides of a geometrical separation surface that is associated with the row. In a variant, the teeth of at least one row, e.g. of long teeth or of short teeth, may be offset on opposite sides of the separation surface, not alternately, but in groups of teeth, e.g. in groups of two or three teeth.

Still in a variant, the teeth may be offset not on opposite sides of a surface, but disposed in a pattern that is repeated along the longitudinal axis of the row, each pattern comprising three or four teeth, for example, in alignment along a line that extends obliquely relative to the axis of the row, for example.

Two consecutive teeth of a row need not be images of each other that are merely shifted in translation, in particular when the cross-sections of the teeth are non-circular in shape.

At least two consecutive teeth of a row of teeth may have first faces both having a common first shape, e.g. plane, at least at the bottom portion of the tooth, for example, and second faces both having a common second shape, e.g. not plane, in particular rounded. The first faces may all face in the same direction around the core, i.e. they may all face clockwise or counter-clockwise, when the core is observed along its longitudinal axis.

The first faces of the teeth, in particular when they are plane, may be connected substantially perpendicularly to the corresponding face of the core, at least for some teeth in the row. At least one tooth, or even all of the teeth, may present a plane face that is parallel to their long direction.

The cross-section of at least one tooth, or even of each tooth, may be of substantially semi-circular or semi-elliptical in shape, e.g. D-shaped, or it may be of still some other shape.

At least one tooth may present a cross-section that is: circular; polygonal, in particular triangular, square, rectangular, octagonal, parallelogram-shaped, lozenge-shaped; or oval. At least one tooth may present at least one portion in relief. Such a characteristic may improve the adherence of the composition to the tooth. Without changing in shape, the cross-section of the tooth may decrease on going away from the core, e.g. over more than half of the length of the tooth. At least two teeth may be of shape that is different, e.g. of cross-section that is different, or of longitudinal section that is different. At least one tooth may be frustoconical in shape. At least one tooth may be cylindrical in shape.

The teeth may optionally be rectilinear, e.g. each extending along a long axis for the tooth that is rectilinear, or else they may be curved, or they may even be undulating. The term "long axis of the tooth" is used to mean an axis that passes via the centers of gravity of the cross-sections of the tooth.

The free ends of the teeth may define an envelope surface that extends along a longitudinal envelope axis that forms a non-zero angle with the longitudinal axis of the core.

The envelope surface may be of width that is substantially constant over at least a fraction of the length of the applicator member.

The envelope surface may also have a cross-section that varies, the envelope surface being, for example, in the shape of a peanut, an American football, frustoconical, or a hybrid comprising two half-shapes selected from amongst the above-mentioned shapes and fitted together along a diametral plane containing the longitudinal axis of the core, e.g. one portion in the shape of half an American football adjacent to a portion that is semi-frustoconical.

Each of the rows of teeth may extend on the core along a longitudinal axis of the row. The longitudinal axis of the row is a central axis for the bases of the teeth of the row, being the straight line passing via the centers of gravity of the bases of the teeth for teeth that are rigorously in alignment, and the axis passing via the separation surface for teeth that are disposed in a staggered configuration in the row.

Since the longitudinal axis of a row is considered at the surface of the core, two longitudinal axes of two successive rows, around the longitudinal axis of the core, may be separated angularly by an angle that is less than 80°, e.g. about 60°, or even less than 50°, e.g. about 45° or less. The distribution of the longitudinal axes of the rows at the surface of the core may be substantially regular, with spacing between them that is substantially constant and equal to a predefined value ±20%, better ±5%.

The implantation and the distribution of the teeth on the core may be relatively regular, or even substantially constant.

Teeth may be situated along the core, around the longitudinal axis of the core, at intervals of about one every 360°/n, for example, with n lying in the range 3 to 20, better in the range 4 to 16, better still in the range 6 to 10. Such a relatively regular disposition of the teeth around the longitudinal axis of the core may enable the applicator to be used starting from any position.

The core may not comprise a toothless region that extends angularly over more than one eighth of a turn. By way of example, the teeth may extend in at least six different directions around the longitudinal axis of the core.

The applicator may comprise a large number of teeth, the teeth being close together so as to avoid too much composition being loaded between them, as would result from spacing that is too great.

Each of the teeth may extend along a long direction that is perpendicular to the surface of the core, or, in a variant, that is not perpendicular, forming a non-zero angle with the normal to the core at the base of the teeth.

In embodiments of the invention, the teeth are made with the core by molding or by over molding.

The applicator may be made with a disposition of teeth on the core that makes it easier for the eyelashes to come into contact with the core, which may present a surface state that is perfectly defined, which is not always true of a conventional brush having a twisted core.

In an embodiment of the invention, the eyelashes may be loaded with composition that is in contact with the core. The core may thus participate in active manner in applying composition to the eyelashes, thereby offering more freedom in the choice and the arrangement of the teeth.

At least one tooth of a row may extend, at least at its portion that is connected to the core, or even over its entire length, along a first direction $Z_1$, perpendicular to the longitudinal face of the core to which the tooth is connected, or forming a small angle with the normal, e.g. less than 10°, better 5°. A consecutive tooth of the row may extend from the same face of the core along a second direction $Z_2$, at least at the portion that is connected to the core, or even over its entire length, forming an angle $\alpha$ with the first direction, when the core is observed along its longitudinal axis.

Substantially half of the teeth of a row may extend parallel to the first direction $Z_1$. The angle $\alpha$ between the directions $Z_1$ and $Z_2$ may lie in the range 5° to 80°.

The teeth may be attached perpendicularly to the core or they may be attached at an angle such that all of the teeth face in the same direction around the core, when the core is observed along its longitudinal axis. The applicator member thus need not have teeth that are oriented in opposite directions around the core. For example, when the core is observed from its distal end, all of the teeth that extend obliquely may be oriented in the clockwise direction.

The core may comprise at least one longitudinal face that is plane. In a variant, the core may comprise at least one longitudinal face that is not plane, e.g. being concave or convex, at least in part.

When observed perpendicularly to its longitudinal axis, the core may present a profile that varies. In particular, the core may present a transverse dimension that reaches a minimum in a central portion of the core, along its longitudinal axis.

Over at least a fraction of its length, the core may present a cross-section that is: circular; polygonal, in particular square, rectangular, pentagonal, hexagonal, octagonal; or oval. The cross-section may have the shape of a polygon that is optionally regular, and that is preferably regular, the sides corresponding to the longitudinal faces of the core possibly being straight or slightly concave or convex.

Over the major fraction of its length, the core may thus present a cross-section that is not circular.

At least one tooth, better each tooth of a row or of the applicator, may extend from a corresponding non-plane longitudinal face of the core in a manner that is substantially perpendicular to a plane that is tangential to the core at said tooth. For example, for a cylindrical core of circular cross-section, the teeth may extend radially.

The core may present a longitudinal face that is concave or convex in cross-section, and that has concavity or convexity that may vary along the longitudinal axis of the core.

The core may present at least one face from which teeth extend, the face presenting a width that varies along the longitudinal axis of the core.

The core may present, at a first location along the longitudinal axis of the core, a first cross-section that is substantially polygonal, and, at a second location along the longitudinal axis, a second cross-section that is substantially polygonal, at least a first vertex of the first cross-section being connected to at least a second vertex and to a third vertex of the second cross-section via respective edges, the first and second vertices being offset angularly around the longitudinal axis of the applicator member. At least one of the first and second cross-sections may be centered on the longitudinal axis of the core.

The core may present a cross-section that is substantially constant, at least over a fraction of its length. The core may also present a cross-section that varies. The cross-section of the core may pass through an extremum, e.g. substantially mid-way along the core, the extremum being a minimum, for example. This may impart increased flexibility to the core, and makes it possible to define an envelope surface of section that varies along the applicator member, in particular when the teeth in a row are of the same length, at least over a fraction of the length of the applicator member.

In a variant, the length of the teeth may vary along the row, such that the cross-section of the core and the cross-section of the envelope surface of the applicator member defined by the free ends of the teeth are not geometrically similar.

The envelope surface of the applicator member may present, at a first location along the longitudinal axis of the applicator member, a first cross-section that is substantially polygonal, and, at a second location along the longitudinal axis, a second cross-section that is substantially polygonal, at least a first vertex of the first cross-section being connected to at least a second vertex and to a third vertex of the second cross-section via respective edges, the first and second vertices being offset angularly around the longitudinal axis of the applicator member, at least one of the first and second cross-sections being centered on the longitudinal axis of the applicator member.

The core may present a longitudinal face that is twisted. The applicator member may present a helical distribution of the teeth on the core, oriented clockwise or counter-clockwise on going towards the distal end of the applicator member.

The applicator may comprise a single row of teeth per longitudinal face of the core.

The length of the applicator member may lie in the range about 10 mm to 48 mm, in particular in the range 15 mm to 38 mm, or even in the range 20 mm to 35 mm, e.g. being about 27 mm.

The length of the applicator member may be defined as the length of the envelope surface defined by the free ends of the teeth measured along the longitudinal axis.

The length of a row may lie in the range about 10 mm to 45 mm, in particular in the range 15 mm to 35 mm, or even in the range 20 mm to 30 mm, e.g. being about 25 mm.

When the core is observed along its longitudinal axis, it is possible to pass from one row to the others by turning the core about its longitudinal axis through an integer sub-multiple of 360°, e.g. turning through 360°/n, where n is an integer that lies in the range 3 to 20, for example.

In a cross-section plane, the core may present axial symmetry, in particular around its longitudinal axis.

The core may extend along a longitudinal axis that, at at least one point along its length, forms an angle with the longitudinal axis of a stem to which the core is fastened. The core may be bent where it connects to the stem.

The core may comprise a recess in which there is engaged a support portion, e.g. made of metal or plastics material. The core may be configured to be fastened to the support, or it may be free to turn or to move in translation relative to the support.

In a variant, the portion of the core that supports the teeth may be solid. The core may comprise a housing at one of its ends only, so as to enable it to be fastened to a stem connected to a handle.

The core may have a greatest transverse dimension, measured perpendicularly to its longitudinal axis, e.g. a diameter, lying in the range 1.2 mm to 6 mm.

The core and the teeth may be molded out of the same material, or, in a variant, they may be made out of at least two different materials. By way of example, a portion of the core and of the teeth may be made out of a first material, and another portion of the core and of the teeth may be made out of a second material. In addition, the teeth of a single row of teeth may be made out of different materials, e.g. of different hardness or color. By way of example, the material of the core may be of a hardness that is different from the hardness of the teeth. The two above-mentioned materials may have surface tensions relative to the composition that are different.

The teeth may be made integrally with the core, e.g. by molding, in particular by injection-molding. The teeth may be formed by mono-injecting material or by over-injecting, preferably using a thermoplastic material, which may be elastomeric. By way of example, the applicator member may be made by injection into a core that is open in such a manner as to enable the passage of the material for making the teeth. In a variant, the applicator member may be made by dual-injection, e.g. by injecting two materials simultaneously into a single mold.

The teeth may be made of a material that is more rigid or less rigid than a material that is used to make the stem of the applicator to which the core is connected.

At least one of the core and a tooth may present magnetic properties. By way of example, the magnetic properties may result from a filler of magnetic particles, e.g. of ferrites, that are dispersed in the plastics material of the core and/or of the teeth.

At least one of the core and a tooth may be flocked and/or may comprise a filler for improving sliding, for example.

The applicator member may comprise two opposite longitudinal portions, e.g. two halves, each comprising teeth and a core portion, e.g. each extending through about 180° around the longitudinal axis of the core. The teeth of each of the two portions may differ from each other by at least one of their length, thickness, shape, arrangement on the core, spacing in the row, and material.

The applicator may comprise a stem at a first end of which the applicator member is fastened. The core may be constituted by a separate piece that is fitted to the stem of the applicator. The core may be fastened to the stem of the applicator by inserting an endpiece that extends the visible portion of the core into a housing formed at the end of the stem. In a variant, the core may comprise a housing that extends longitudinally, and into which the stem is inserted. Still in a variant, the core may be made integrally with the stem of the applicator by molding a plastics material.

The core may be made of a plastics material that is more flexible or less flexible than the plastics material that is used to make the stem of the applicator.

By way of example, the diameter of the stem may lie in the range 3 mm to 3.5 mm.

The stem may be connected to a handle at a second end remote from the first, which handle may be configured to close, in leaktight manner, a receptacle containing the composition to be applied. The receptacle may comprise a wiper member that may be adapted to wipe the stem and the applicator member.

The applicator may be free of any metal, thereby making it possible to put it in a microwave oven.

Where appropriate, the core may have a hollow inside, and it may comprise at least one channel via which the composition can pass through the applicator member.

Independently or in combination with the above, the invention also provides an applicator for combing the eyelashes and/or the eyebrows and/or for applying a composition thereto, the applicator comprising a molded applicator member, comprising:

an elongate core that extends along a longitudinal axis; and at least three rows, better at least six rows, of teeth that are connected to the core, the rows extending along the longitudinal axis of the core, having at least one row of long teeth and at least one row of short teeth, with not all of the long teeth being parallel.

Independently or in combination with the above, the invention also provides an applicator for combing the eyelashes and/or the eyebrows and/or for applying a composition thereto, the applicator comprising a molded applicator member, comprising:

an elongate core that extends along a longitudinal axis; and at least three rows, better at least six rows, of teeth that are connected to the core, the rows extending along the longitudinal axis of the core, having at least one row of long teeth and at least one row of short teeth, the difference between the length of the long teeth and the length of the short teeth being at least 0.3 mm, the difference representing at least 20% of the length of the short teeth.

Independently or in combination with the above, the invention also provides an applicator for combing the eyelashes and/or the eyebrows and/or for applying a composition thereto, the applicator comprising a molded applicator member, comprising:

an elongate core that extends along a longitudinal axis; and at least three rows, better at least six rows, of teeth that are connected to the core, the rows extending along the longitudinal axis of the core, having at least one row of long teeth and at least one row of short teeth, the rows being disposed in groups of close-together rows, the groups of close-together rows being distributed in regular manner around the longitudinal axis of the core.

The invention also provides a packaging and applicator device for applying a composition to keratinous fibers, in particular the eyelashes or the eyebrows, the device comprising an applicator as defined above, and a receptacle containing the composition. The handle of the applicator may constitute a closure cap for closing the receptacle.

The composition may be a mascara, e.g. a water-resistant mascara. By using an applicator of the invention, its application is made easier.

The invention also provides a method of applying makeup to the eyelashes or the eyebrows by means of an applicator as defined above.

The invention can be better understood on reading the following detailed description of non-limiting embodiments thereof, and on examining the accompanying drawings, in which:

FIGS. 5 & 6 and 7 & 8 are views similar to FIGS. 2 and 3 of two variant embodiments;

Figure 3:
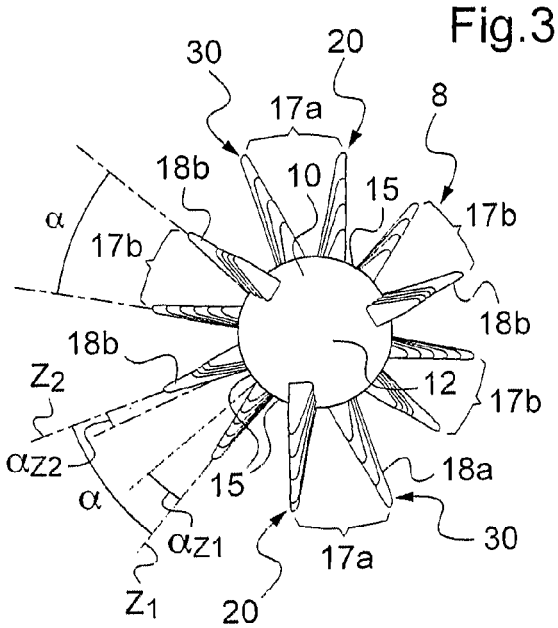
FIG. 3 is a view as seen looking along arrow III in FIG. 2.
Figure 2:
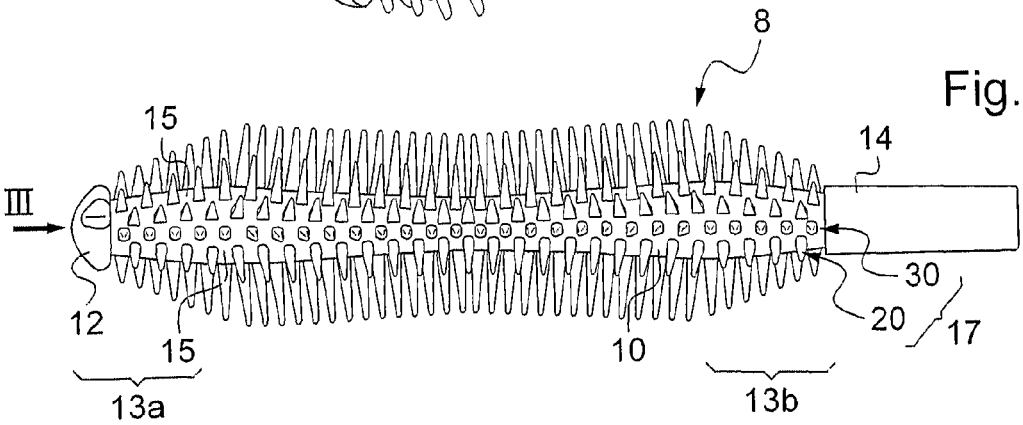
FIG. 2 is a side view of the FIG. 1 applicator member shown in isolation.

FIGS. 9, 10, 10*a*, and 11 to 13 and are diagrammatic and fragmentary cross-sections of variant embodiments;

FIGS. 14 to 16 and 16*a* are views similar to FIG. 3 showing variant embodiments;

FIGS. 17, 17*a*, 17*b*, 18 to 20, 20*b*, and 20*c* are diagrammatic and fragmentary views showing arrangements of teeth;

FIG. 20*a* is a diagrammatic and fragmentary side view of a variant embodiment;

FIG. 20*d* is a view similar to FIG. 2 showing the variant embodiment of FIG. 20*b;*

Figure 45:
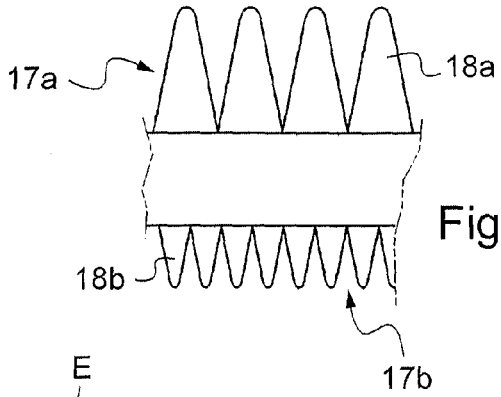
Figure 42:
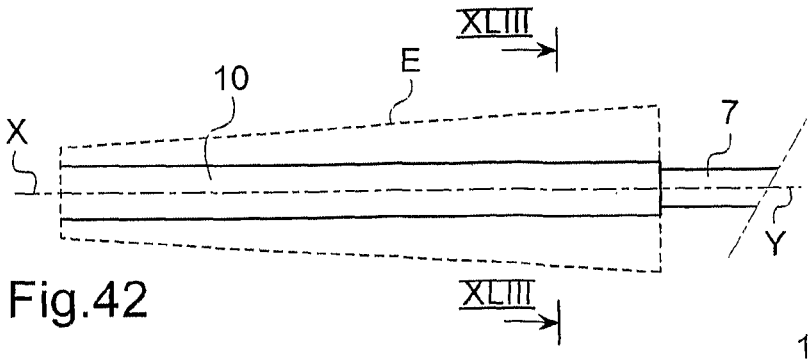
Figure 43:
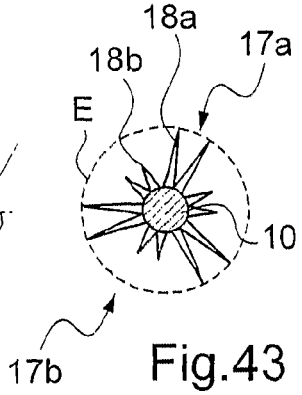
Figure 44:
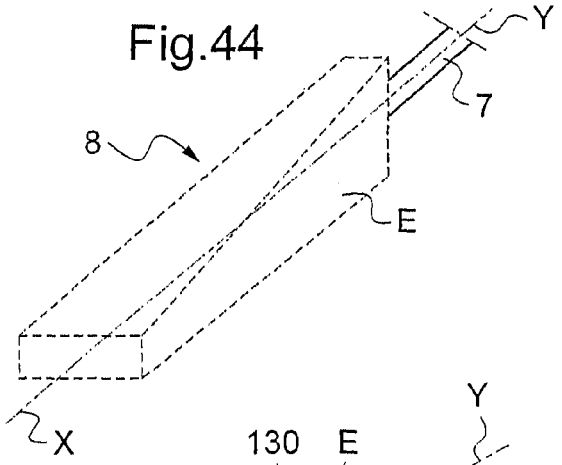
Figure 46:
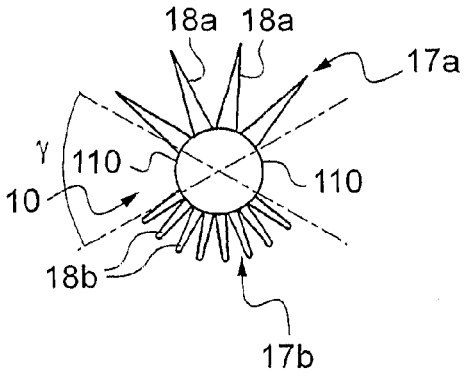
Figure 47:
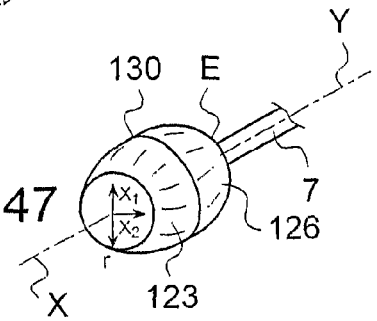
Figure 48:
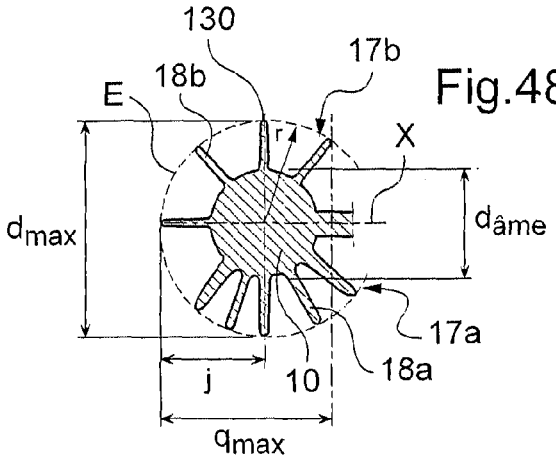
Figure 49:
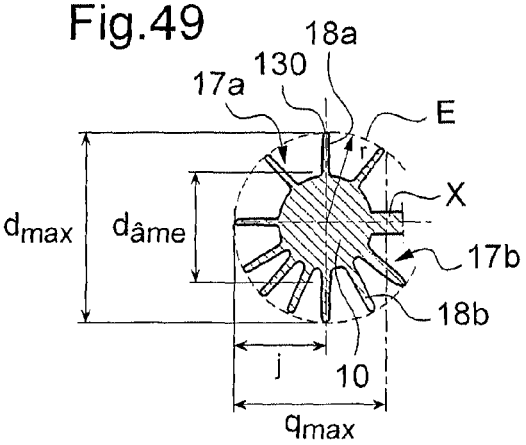
Figure 50:
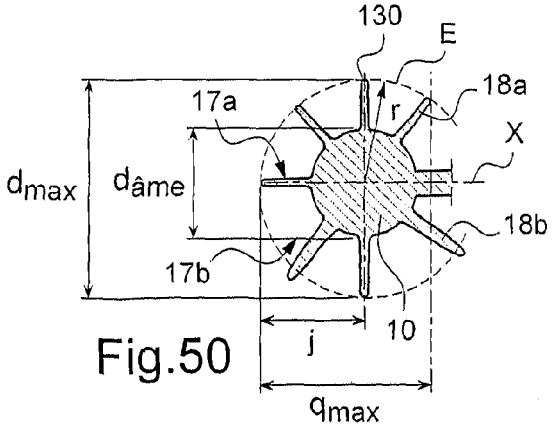
Figure 51:
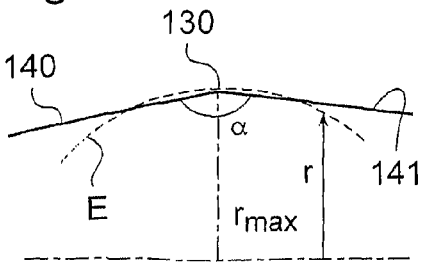
Figure 54:
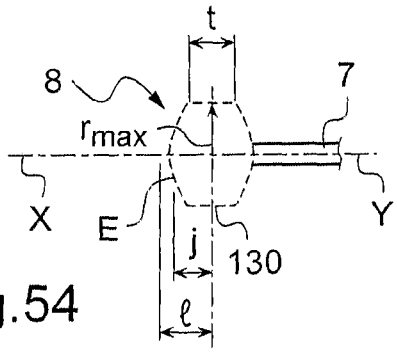
Figure 55:
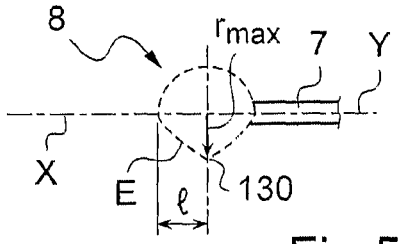
Figure 56:
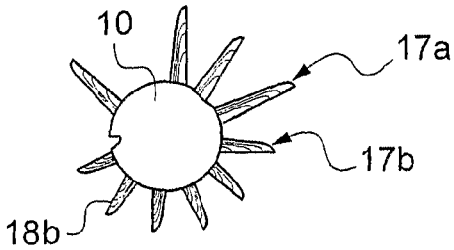
Figure 57:
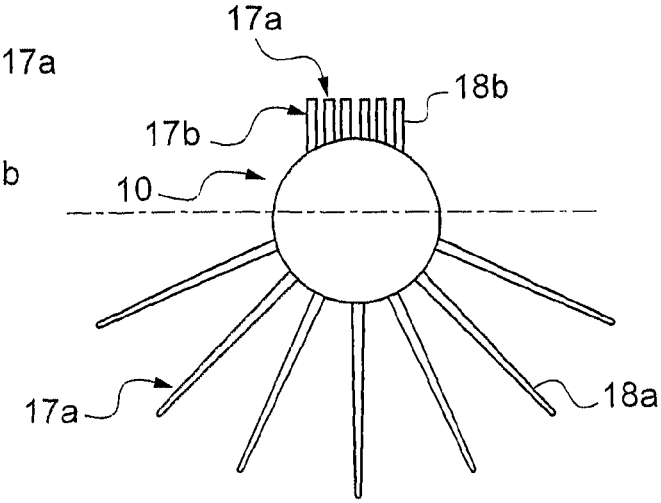

FIGS. 21, 21*b*, 21*d* and 21*f* are fragmentary perspective views of variant embodiments;

FIGS. 21*a*, 21*c*, 21*e* and 21*g* are diagrammatic and fragmentary views along the longitudinal axis showing variant embodiments;

FIGS. 22 to 26 are cross-sections of teeth;

FIG. 27 is a perspective view of a variant embodiment;

FIG. 28 is a view similar to FIG. 2 showing another variant;

FIGS. 29, 29*a*, 30 to 42 are diagrams of envelope surfaces of other variant embodiments;

FIG. 43 is a cross-section on ILIII of FIG. 42;

FIG. 44 shows another example of envelope surface;

FIG. 45 shows the possibility of having different numbers of teeth on either side of the core;

FIG. 46 is a diagrammatic cross-section of a variant embodiment of the applicator member;

FIG. 47 is a diagram showing the envelope surface of a variant embodiment of the applicator member;

FIGS. 48 to 50 are diagrammatic longitudinal sections showing various embodiments of the applicator member;

FIG. 51 shows an embodiment detail;

FIGS. 52 to 55 show other examples of envelope surfaces for the applicator member; and FIGS. 56 and 57 are face views of various embodiments of the applicator member.

FIG. 58 is a fragmentary longitudinal section of a variant embodiment;

FIGS. 59 to 61 show variant embodiments of teeth;

FIG. 62 is a diagrammatic and fragmentary cross-section of a variant embodiment of the wiper member; and FIGS. 63 and 64 show details of variant embodiments of the stem.

Figure 1:
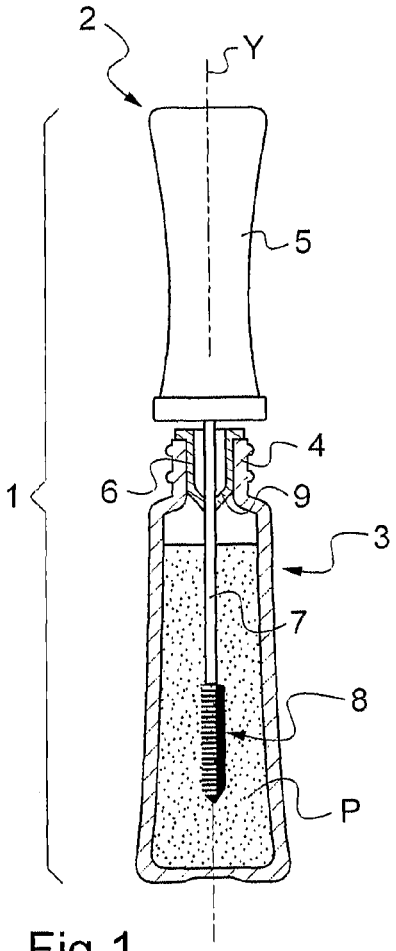
FIG. 1 is a diagrammatic and fragmentary longitudinal section view in elevation showing an example of a device made in accordance with the invention.

FIG. 1 shows a packaging and applicator device made in accordance with the invention, the device comprising an applicator 2 and an associated receptacle 3 containing a composition P for application to the eyelashes and/or the eyebrows, e.g. mascara or a care product.

By way of example, the applicator of the invention makes it possible to use a water-resistant mascara.

In the embodiment under consideration, the receptacle 3 comprises a threaded neck 4, and the applicator 2 comprises a closure cap 5 that is arranged to be fastened on the neck 4 so as to close the receptacle 3 in leaktight manner when not in use, the closure cap 5 also constituting a handle for the applicator 2.

The applicator 2 comprises a stem 7 of longitudinal axis Y, which stem is connected at its top end to the closure cap 5, and at its bottom end to an applicator member 8.

The receptacle 3 also comprises a wiper member 6 that is inserted in the neck 4.

In the embodiment under consideration, the wiper member 6, that may be of any type, comprises a lip 9 that is arranged to wipe the stem 7 and the applicator member 8 while the applicator 2 is being removed from the receptacle 3. The lip 9 defines a wiper orifice of diameter that is adapted to the diameter of the stem.

In the embodiment shown, the stem 7 presents a cross-section that is circular, but it is would not be beyond the ambit of the present invention for the stem 7 to present some other section, the cap 5 thus possibly being fastened on the receptacle 3 other than by screw-fastening, if necessary. The wiper member 6 could be adapted to the shape of the stem 7 and to the shape of the applicator member 8, where appropriate.

In the embodiment under consideration, the longitudinal axis Y of the stem 7 is rectilinear and coincides with the longitudinal axis of the receptacle 3 when the applicator 2 is in place thereon, but would not be beyond the ambit of the present invention for the stem 7 to be non-rectilinear, e.g. forming a bend.

Where appropriate, the stem 7 may comprise an annular narrowing at its portion that comes to be positioned facing the lip 9 of the wiper member 6, so that said wiper member is not mechanically stressed unduly during storage.

Figure 4:
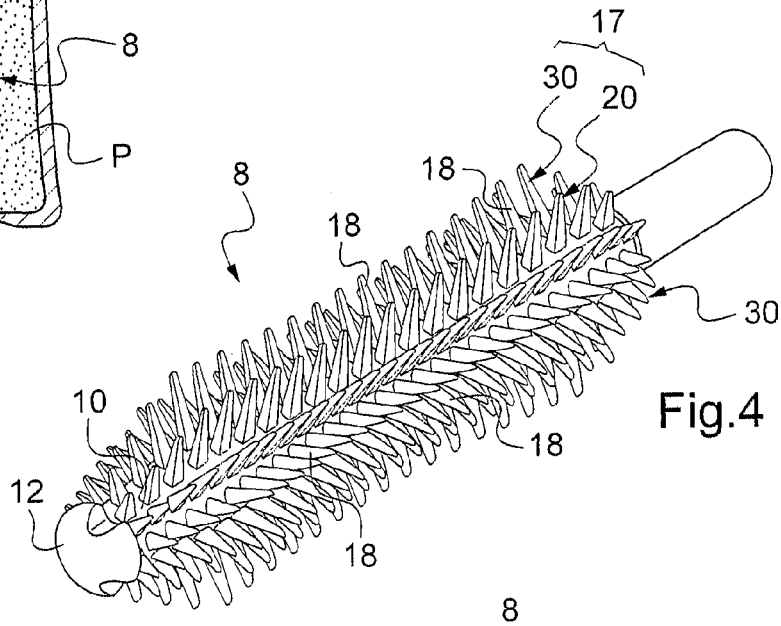
FIG. 4 is a perspective view of the applicator member in FIGS. 1 to 3.

With reference to FIGS. 2 to 4, it can be seen that the applicator member 8 comprises a core 10 of elongate shape, extending along a longitudinal axis X.

In the embodiment under consideration, over the majority of its length, the core 10 presents a cross-section that is polygonal, having sides that define longitudinal faces 15. In the embodiment described, the faces 15 are concave in their central portion. The longitudinal axis X is central.

In the embodiment shown, a single row 17 of teeth 18 is connected to each of the longitudinal faces 15.

In the embodiment under consideration, the teeth 18 are made integrally with the core 10 by molding thermoplastic material.

In order to mold the applicator member 8, it is possible to use a thermoplastic material that is optionally relatively rigid, e.g. styrene-ethylene-butylene-styrene (SEBS); a silicone rubber; latex rubber; butyl rubber; ethylene-propylene-terpolymer rubber (EPDM); a nitrile rubber; a thermoplastic elastomer; a polyester, polyamide, polyethylene, or vinyl elastomer; a polyolefin such as polyethylene (PE) or polypropylene (PP); polyvinyl chloride (PVC); ethyl vinyl acetate (EVA); polystyrene (PS); polyethylene terephthalate (PET); polyoxymethylene (POM); polyamide (PA); or polymethyl methacrylate (PMMA). In particular, it is possible to use materials known under the trade names Hytrel®, Cariflex®, Alixine®, Santoprene®, Pebax®, this list not being limiting.

Where appropriate, the applicator member 8 may also be made by molding a metal.

The teeth and the core may be made out of different materials.

At its distal end 12, the applicator member 8 may comprise a head that tapers forwards so as to make it easier to put the applicator 2 back into the receptacle 3. The height of the teeth 18 may decrease on going towards the head 12, along a distal transition portion 13*a*, as shown in FIG. 2.

The height of the teeth 18 may also decrease along a proximal transition portion 13*b* on going towards the stem 7, so as to make it easier for the applicator member 8 to pass through the wiper member 6 while the applicator 2 is being removed.

The head 12 may be circularly symmetrical, or it may comprise radial fins, as shown in FIG. 2, or it may have some other shape, or it may even not exist.

In the embodiment under consideration, the core 10 is extended from its proximal end by a cylindrical endpiece 14 that enables it to be fastened onto the stem 7. In particular, fastening may be performed by molding, welding, force-fitting, snap-fastening, adhesive, heat-sealing, or crimping in a housing provided at the end of the stem. In a variant, the stem may be inserted into a housing provided in the core.

The core 10 may also be molded integrally with the stem 7.

In the embodiment described, the longitudinal faces 15 are six in number, the cross-section of the core being substantially hexagonal.

The rows 17 of teeth 18 comprise rows 17*a* of long teeth 18*a* and rows 17*b* of short teeth 18*b*, and more precisely in the embodiment described, as shown in FIGS. 2 to 4, two rows 17*a* of long teeth 18*a* opposite each other on the applicator member 8, separated by rows 17*b* of short teeth 18*b*, i.e. two groups of two rows 17*b* of short teeth 18*b*. In the embodiment shown in FIGS. 1 to 4, the applicator member 8 thus comprises four rows 17*b* of short teeth 18*b*.

In the embodiment described, in addition to their length, the teeth 18*a* and 18*b* also differ in their thickness, the long teeth 18*a* being thicker than the short teeth 18*b*.

In the embodiment shown, the applicator member 8 comprises more than twice as many short teeth 18*b* as long teeth 18*a*. In addition, the long teeth 18*a* are distributed over an angular extent of about 120°, while the short teeth 18*b* are distributed over a total angular extent of about 240°.

A row 17 of teeth 18 is described more precisely below, the description applying equally well to the rows 17*a* of long teeth 18*a*, as to the rows 17*b* of short teeth 18*b*.

The row of teeth may be configured as described in US 2008/0023020.

Each row 17 of teeth 18 comprises a first set 20 of first teeth that are connected to the corresponding face 15 of the core 10 while forming an angle $\alpha_{Z1}$ relative to the normal thereto, and a second set 30 of teeth that are connected to the face 15 obliquely, forming an angle $\alpha_{Z2}$ relative to said normal.

The teeth 18 of the first set 20 of teeth are straight, extending along a direction $Z_1$ that is substantially perpendicular to the face 15, the angle $\alpha_{Z1}$ being relatively small, e.g. less than 10°, or even less than 5°.

The teeth 18 of the second set 30 of teeth are also straight in the embodiment under consideration, extending along a direction $Z_2$, forming an angle $\alpha$ with the direction $Z_1$.

By way of example, the angle $\alpha$ may lie in the range 20° to 80°.

In FIG. 3, it can be seen that each row comprises teeth having a face that is connected perpendicularly to the corresponding longitudinal face 15.

In the embodiment described, the teeth 18 of each row 17 are disposed in a staggered configuration. Two consecutive teeth 18 of each row 17 are offset alternately on opposite sides of a separation surface S, the surface S being a bisector plane of the angle $\alpha$, for example.

The teeth of the first set 20 are disposed on one side of the separation surface, while the teeth of the second set 30 are disposed on the other side of said separation surface, when the core 10 is observed along its longitudinal axis.

Within each row 17, the basis of the teeth of the first set 20 and of the second set 30 are not in alignment, since they are respectively situated entirely on opposite sides of the separation surface.

In the embodiment shown, the teeth of the first set 20 and of the second set 30 do not overlap, when the applicator member is observed from the side along a direction that is perpendicular to the axis X, as shown in FIG. 2.

In addition, the directions $Z_1$ and $Z_2$ of the teeth 18 of the first and second sets 20 and 30 of teeth do not intersect the longitudinal axis X of the core, the teeth being excentric relative to the axis.

The oblique teeth 18 of the various rows face in the same direction around the core, i.e. the clockwise direction in FIG. 3.

In addition, the greatest transverse dimension D of the applicator member may be less than or equal to 7 mm, better less than or equal to 6 mm, better less than or equal to 5.7 mm. In the embodiment shown in FIGS. 1 to 4, the applicator member comprises a number of rows of long teeth that is different from the number of rows of short teeth, but it would not be beyond the ambit of the present invention for this to be otherwise.

By way of example, FIGS. 5 and 6 show an embodiment comprising three rows of long teeth and three rows of short teeth in alternation with one another. In addition, the angular extent occupied by the long teeth is equal to the angular extent occupied by the short teeth. In the figures, the teeth are implanted on each longitudinal face in manner similar to the implantation shown in FIG. 3.

In yet another variant embodiment, shown in FIGS. 7 and 8, the applicator member 8 comprises four rows 17*a* of long teeth 18*a* distributed in groups of two rows, in alternation with two rows 17*b* of short teeth 18*b*.

The embodiment differs further from the embodiments shown in FIGS. 1 to 6 by the fact that, although the core presents a central concavity, the teeth define, at least for the teeth of a central portion of the applicator member 8, an envelope surface of shape that is substantially cylindrical. Thus, the length of the teeth disposed in the central portion may be slightly greater than the length of the teeth disposed in the distal and proximal portions of the applicator member, so as to compensate said concavity.

Still in a variant, the faces of the core could be plane.

In all of the above-described embodiments, the core comprises six longitudinal faces and has a cross-section that is of hexagonal shape.

The core may comprise any number of longitudinal faces, with it being possible for any of the above-described characteristics to apply regardless of the number of longitudinal faces.

The core may present a cross-section that is square, as shown in FIG. 9, circular, as shown in FIG. 10, or oval, as shown in FIG. 10*a*, or even triangular, octagonal, or pentagonal, as shown in FIGS. 11, 12, and 13 respectively.

An applicator member 8 of the invention may comprise more than two visible teeth per longitudinal face, when the core is observed along its longitudinal axis, and, in addition to the first and second teeth 18 of the sets 20 and 30, may comprise one or more additional teeth 18, e.g. forming an angle $\beta$ that is greater than $\alpha$ with the direction $Z_1$, or even extending perpendicularly to the face of the corresponding core.

It would not be beyond the ambit of the present invention for the teeth of the second set 30 of teeth not to slope relative to the longitudinal face 15 of the core to which they are connected, and for the directions $Z_1$ and $Z_2$ to be parallel for each row 17.

In the embodiments shown in FIGS. 1 to 8, the applicator member 8 comprises six rows of teeth 17, but it would not be beyond the ambit of the present invention for it to comprise more, e.g. eight or nine as shown in FIGS. 14 to 16.

In the embodiment shown in FIG. 14, the rows 17*a* of long teeth 18*a* alternate with the rows 17*b* of short teeth 18*b*, a row of long teeth succeeding a row of short teeth around the longitudinal axis of the applicator member 8.

In the embodiment shown in FIG. 15, the rows 17*a* of long teeth are grouped together in groups of two and the same applies for the rows 17*b* of short teeth, such that two rows of long teeth alternate with two rows of short teeth around the longitudinal axis of the applicator member 8.

Finally, in the embodiment shown in FIG. 16, two rows of short teeth alternate with one row of long teeth, such that the applicator member comprises three rows of long teeth and six rows of short teeth.

In the embodiments described above, the rows of teeth may differ in the length, the thickness, and the spacing of the teeth in the row, but it would not be beyond the ambit of the present invention if this were otherwise.

By way of example, FIG. 17 shows an applicator member comprising two rows of teeth that differ in the spacing of the teeth in the row. This figure also shows the longitudinal axes of the rows.

Figure 17A:
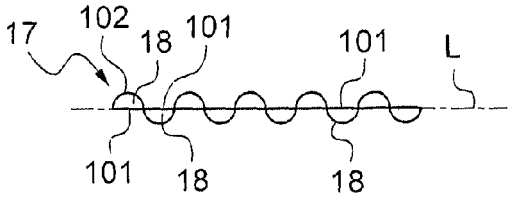

Within a row 17, the consecutive teeth 18 may present respective first faces 101 that are substantially plane. The opposite faces 102 of the teeth may be in the form of half a cone or half a pyramid, for example. The teeth 18 may be oriented in alternation with their faces 101 facing towards the midplane of the row and outwards from the row, as shown in FIG. 17*a*. Such a disposition of the teeth can make it easier to mold the row of teeth, since all of the teeth having their faces 101 facing in a given direction are molded by the same mold shell, while all of the other teeth of the row, having their faces 101 facing in the opposite direction are molded by another mold shell. These two mold shells come into contact with each other.

Figure 17B:
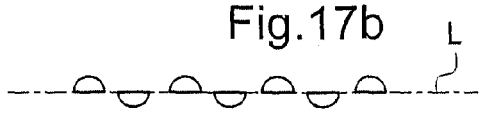

The teeth 18 may touch to a greater or lesser extent within the row, as shown in FIGS. 17*a* and 17*b*. In particular, the teeth 18 may be substantially touching as shown in FIG. 17*a*, i.e. in contact or with small spacing between one another, e.g. spacing less than or equal to 0.1 mm at their bases. The disposition of the bases of the teeth shown in FIGS. 17*a* and 17*b* may be applied to all of the applicator members described in the present application.

FIG. 18 shows two rows of teeth that differ in the thickness of the teeth in each row.

Still in a variant, the applicator member may comprise only a single row 17*a* of long teeth, as shown in FIG. 16*a*.

In the embodiments described above, the teeth of the first and second sets 20 and 30 of teeth 18 of a row 17 are disposed in a staggered configuration, with their bases not being in alignment.

As shown in FIG. 19, this could be otherwise and the bases of the teeth 18 could be in alignment, on a common line L that is parallel to the longitudinal axis X of the core 10 intersecting all of the bases of the aligned teeth of the row, the line constituting the longitudinal axis L of the row.

In addition, FIG. 19 shows rows in which the teeth are spaced apart differently and present different thicknesses.

In the embodiment in FIG. 20, one row comprises teeth that are in alignment, and the other row comprises teeth that are disposed in a staggered configuration.

When observed perpendicularly to the longitudinal axis of the core, an applicator member may comprise rows of teeth having profiles that have the same identical shape, as shown in FIGS. 1 to 7, or that are different, as shown in FIG. 20*a*.

In the FIG. 20*a* embodiment, the two rows of teeth 17 have different profiles, one being in the shape of a camel's back, presenting a central concavity, and the other presenting a central flat.

In the above-mentioned embodiments in FIGS. 17 to 20, one or the other of the rows may be a row of short teeth, and one or the other of the rows may be a row of long teeth. The two rows may also be rows of short teeth or rows of long teeth.

When the applicator is observed perpendicularly to its longitudinal axis, two consecutive teeth of a row may define a V-shaped groove, as shown in FIG. 21.

When the applicator member is observed along its longitudinal axis, two consecutive teeth of a row may also form a V-shape, as shown in FIG. 21.

It can be seen in FIGS. 21*b* and 21*c* that, within a row, the applicator may comprise patterns of four teeth, of which the middle two form a V-shape. The four teeth succeed one another along the longitudinal axis of the row. The teeth are not contained in a single plane, perpendicular to the longitudinal axis of the core.

In the embodiment shown in FIGS. 21*d* and 21*e*, the row 17 comprises patterns of three teeth, of which two teeth form a V-shape with a central tooth between them.

Figure 21F:
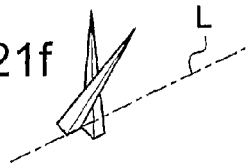

Two consecutive teeth of a row may cross when the row is observed along its longitudinal axis L, as shown in FIG. 21*f*.

Figure 21G:
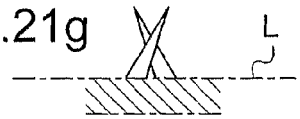

In a variant, two consecutive teeth of a row may cross when the row is observed perpendicularly to its longitudinal axis L, as shown in FIG. 21*g*, the two crossing teeth then being directed respectively towards the proximal end and towards the distal end of the applicator member. Within each row, the teeth could be grouped together, e.g. in groups of two. Naturally, the teeth could be grouped together other than in pairs, the spacing between the groups of teeth within the same row optionally being uniform, and for example greater than the average spacing between the teeth within a group.

A plurality of rows of sufficiently close-together teeth may form a group of close-together rows, extending along a longitudinal axis G that is parallel to the longitudinal axes L of each of the rows, and that is central relative to said rows.

By way of example, FIG. 20*b* shows two groups of two close-together rows, and FIG. 20*c* shows one group of three close-together rows. The longitudinal axis G of the groups of close-together rows is situated at equal distances from the two longitudinal axes L of the two extreme rows of the group of close-together rows.

FIG. 20*d* shows an applicator member having teeth that are implanted on the core in the same manner as shown in FIG. 20*b*. The teeth of a single group of close-together rows of teeth are parallel to one another. In this embodiment, the applicator member comprises six groups of two close-together rows that are evenly distributed over the periphery of the core, with two groups of close-together rows having long teeth and four groups of close-together rows having short teeth.

The closest teeth of two adjacent rows of the same group of close-together rows are spaced-apart by a distance d that is less than 0.8 mm, the distance possibly being less than the thickness of a tooth, or even zero, the teeth of the two close-together rows thus being touching. The teeth of two different groups of close-together rows may be spaced-apart on the core by a distance d' that is much greater than d, e.g. more that twice, or even three times d.

Two groups of close-together rows are spaced apart by a distance e measured between the axes G.

In a variant, the applicator member may comprise isolated rows and groups of close-together rows.

The distance e is measured between the axes G of the groups of close-together rows and the axes L of the isolated rows.

In addition, in the embodiments described above, each tooth 18 may comprise a first longitudinal face 40 of plane shape and a second longitudinal face 41 of rounded shape, in particular of convex shape.

In a variant, at least one tooth may have a cross-section that is circular, as shown in FIG. 22, or even triangular, as shown in FIG. 23, or lozenge-shaped, as shown in FIG. 24, or even formed of two different-size adjacent triangles, as shown in FIG. 25, or triangular with a groove, as shown in FIG. 26.

The longitudinal faces 15 of the core 10 need not be plane, e.g. being concave or convex over at least a fraction of their length, as in the embodiment in FIG. 1. In this embodiment, the core 10 comprises longitudinal faces 15 that are concave at least in part, the concave shapes being centered on a mid-plane of the core 10, e.g. intersecting said core substantially half-way along.

The concave shapes of the longitudinal faces 15 may be formed by a narrowing of the cross-section of the core 10.

In a variant embodiment, the longitudinal faces 15 of the core 10 are twisted, as shown in FIG. 27, i.e. the corresponding side turns through at least one turn towards the distal end of the core.

The core 10 may be deformed on unmolding by turning the endpiece 14, or, in a variant, it may be deformed in the mold.

The longitudinal axis X of the core 10 may coincide with the longitudinal axis Y of the stem 7, but it would not be beyond the ambit of the present invention for this to be otherwise, and, by way of example, FIG. 28 shows a variant embodiment in which the longitudinal axis X of the core 10 forms an angle $\gamma_1$ with the longitudinal axis Y of the stem. Such a configuration can improve application by making it easier to manipulate the applicator.

The core may extend along a longitudinal axis X that is not rectilinear. FIG. 29 shows a variant embodiment in which the core extends along a longitudinal axis X that is curved. When observed in longitudinal section, as in FIG. 29, the envelope surface E may, on one side of the axis X, present a convex first outline 54 that extends substantially in the same direction as the axis X, and, on the opposite side of the axis X, a concave second outline 55 that extends substantially in the same direction as the axis X.

Figure 29A:
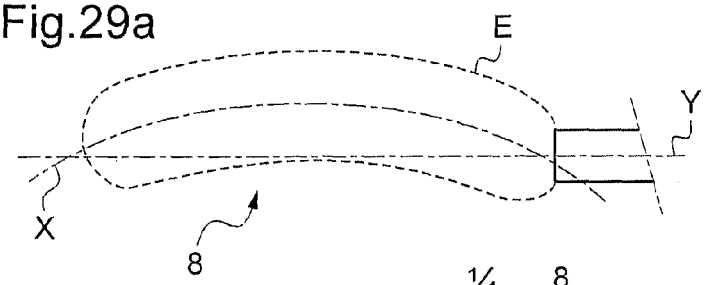

The distal end of the envelope surface may optionally be aligned with the longitudinal axis of the stem. In FIG. 29*a*, there can be seen the possibility for the distal end of the envelope surface E to be in alignment with the longitudinal axis Y of the stem 7.

In the variant shown in FIG. 30, the envelope surface E presents two opposite outlines 54 and 55, of which one 54 is straight.

The applicator member may present a variety of shapes for its envelope surface E. In a variant shown in FIG. 31, the envelope surface E presents a cross-section that passes via a minimum. The axis X coincides with the axis Y.

In the variant shown in FIG. 32, the longitudinal axis X of the core 10 is rectilinear, and the envelope surface E presents an ovoid shape.

In another variant, shown in FIG. 33, the free ends of the teeth 18 define an envelope surface E that extends generally along a longitudinal axis W that forms an angle $\gamma_2$ with the longitudinal axis X of the core 10, where such an applicator member could be said to be excentric.

The FIG. 34 variant differs from the FIG. 33 variant in the shape of the envelope surface E that presents a cross-section that passes via a minimum.

The longitudinal axis X of the core 10 may be rectilinear and may form an angle with the longitudinal axis Y of the stem 7, as shown in FIG. 35, the envelope surface E having, for example, a cross-section that is not constant, e.g. passing via a minimum.

Figure 36:
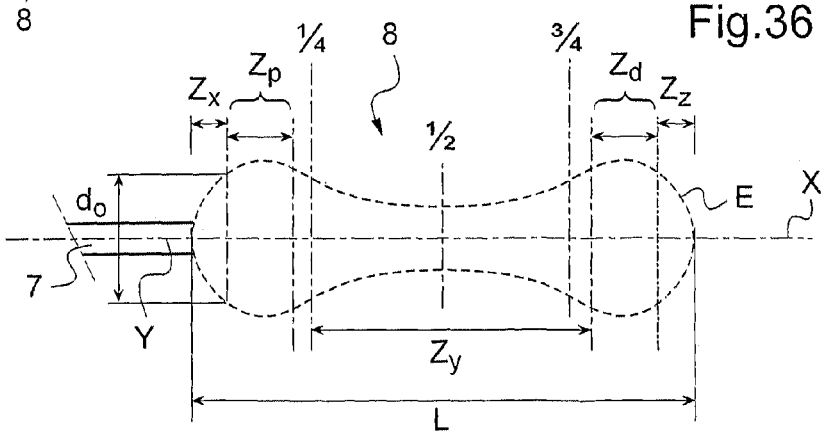

The envelope surface E may be generally peanut-shaped, as shown in FIG. 36. The envelope surface may in particular present two portions of larger cross-section in the vicinities of its proximal and distal ends, with an intermediate portion of smaller cross-section.

For example, it is possible to have portions of larger cross-section with a maximum transverse dimension greater than or equal to 6 mm in zones $z_p$ and $z_d$, these zones respectively lying between the proximal end of the envelope surface and the first quarter of its length and the distal end of the envelope surface and the first quarter of its length going towards the proximal end.

When the envelope surface is a surface of revolution, the zones $z_p$ and $z_d$ may for example be of diameter greater than or equal to a value $d_0$ that is equal to 6 mm, for example.

By way of example, the cumulative length of the portions $z_x$, $z_y$, and $z_z$ inscribed in a cylinder having a diameter of 6 mm occupies more than 70% of the total length L of the applicator member. The maximum diameter in the zones $z_p$, $z_d$ is equal to 6.4 mm, for example, and the minimum diameter in the central portion is equal to 5.4 mm, for example.

Figure 37:
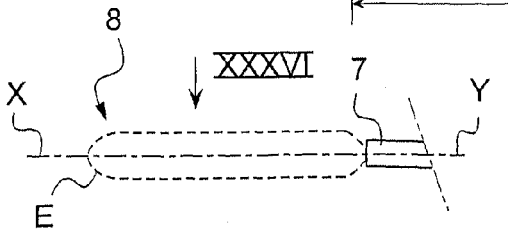

The applicator member may have an envelope surface of varying cross-section, with two portions close to the proximal and distal ends that are not surfaces of revolution about the longitudinal axis of the core. In FIG. 37, there can be seen an applicator member that, when observed from the side along arrow XXXVI in FIG. 37 presents, by way of example, the shape shown in FIG. 36, and when it is observed from above presents a flat shape as shown in FIG. 37.

Figure 38:
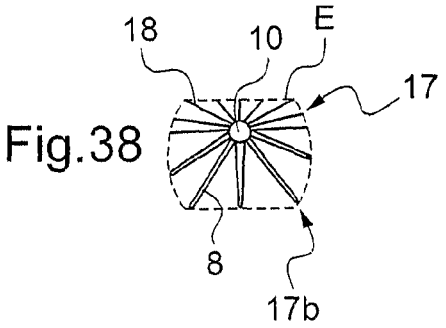
Figure 39:
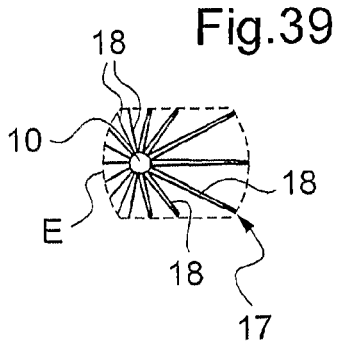

The core 10 may be centered relative to the envelope surface E or it may be off-center relative thereto, as shown in FIGS. 38 and 39. In these examples, it can be seen that the envelope surface E presents a shape in cross-section in a section plane perpendicular to the longitudinal axis X that is generally flat with two opposite faces that are plane and parallel and interconnected by two faces that are outwardly convex.

By way of example, the core 10 is closer to one of the plane faces of the envelope surface than to the other plane face, as shown in FIG. 38, or in a variant it is closer to one of the convex faces of the envelope surface than to the other, as shown in FIG. 39.

Figure 40:
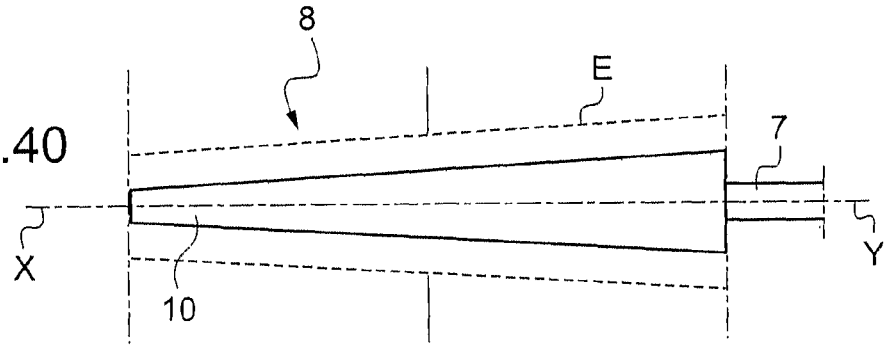
Figure 41:
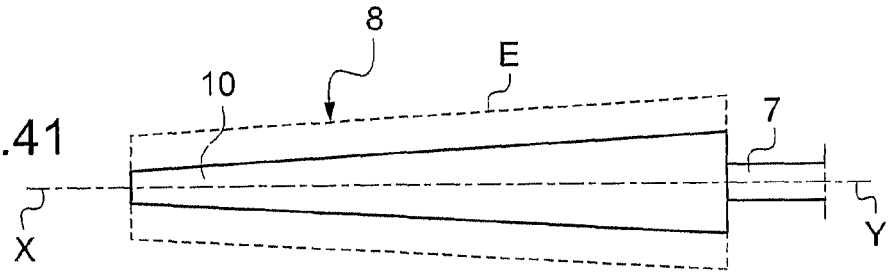

In addition to the shape described above, the applicator member may present an envelope surface E that is generally frustoconical in shape, as shown in FIGS. 40 to 42.

The envelope surface E may have a larger diameter of 7 mm, at its proximal end and a smaller diameter of 4.5 mm at its distal end.

The envelope surface E may be centered on the longitudinal axis X of the applicator member core, as shown in FIG. 40, which axis may also coincide with the longitudinal axis Y of the stem 7, as also shown in this figure.

The core 10 may also be generally frustoconical in shape, as can be seen in FIGS. 40 and 41, or it may be in the form of a cylindrical body of revolution as shown in FIG. 42, or it may have some other shape.

FIG. 41 shows the possibility of the axis of the envelope surface E not coinciding with the axis of the core, e.g. being parallel thereto.

In the example of FIG. 42, and as can also be seen in FIG. 43, it is possible to have three rows of long teeth, e.g. spaced apart by 120°, a row of long teeth follows a row of short teeth around the longitudinal axis.

In the embodiment of FIG. 44, the envelope surface E is of rectangular cross-section, and it presents four longitudinal edges. The rectangle formed by the distal end face is offset by 90° relative to the rectangle formed by the proximal end face, such that the rectilinear edges interconnect the two long sides of the rectangle formed by the distal end face to the two short sides of the rectangle formed by the proximal end face, and vice versa.

In accordance with one of the aspects of the invention, the rows of long teeth may have a number of teeth within the row that differs from the number of teeth within rows of short teeth as shown in FIG. 45.

The rows may not only have different numbers of teeth per row, but the teeth may also be of different thicknesses, as also shown in said figure.

The applicator member may present side surfaces 110 that do not have any teeth, as shown in FIG. 46. By way of example, each side surface 110 extends, as can be seen in the figure, between one of the end rows 17*b* of the set of rows of short teeth and the end row 17*a* of the set of rows of long teeth that is adjacent thereto. By way of example, the angular extent $\gamma$ of a side surface 110 lies for example in the range 0 to 60°, not including the limit of 0.

In FIG. 56, there can be seen the possibility of having one or more rows of teeth that are missing compared with a regular arrangement of rows of teeth on the applicator member.

FIG. 56 shows that a row of teeth is missing close to one of the extreme rows of the set of rows of long teeth 17*a*. In other rows, the rows 17*a* are spaced apart from one another at an angular pitch that is constant, except that two of them are spaced apart at twice that angular pitch, for example.

In numerous embodiments, the rows of short teeth and the rows of long teeth extend in at least three different directions about the longitudinal axis of the core. This is not necessarily so, and by way of example, FIG. 57 shows an applicator member for which the teeth of the rows of short teeth are all parallel, whereas the teeth of the rows of long teeth extend in different directions.

FIGS. 47 to 55 relate to applicators for applying a composition to keratinous fibers, in particular the eyelashes and/or the eyebrows, the applicators comprised a molded applicator member, comprising:

a stem;

a core that extends along a longitudinal axis;

teeth carried by the core, the distal end of the applicator being defined by the core or by at least one tooth; and teeth extending in at least three different directions around the core and defining an envelope surface that grows to a maximum and then decreases in cross-section towards the free end of the applicator.

In accordance with the invention, such applicators may present different rows of teeth, e.g. differing in tooth length, number of teeth, in number of teeth per row, in tooth thickness, and/or in tooth material.

The total length $q_{max}$ along the longitudinal axis of the envelope surface may be less or equal to twice the greatest diameter $d_{max}$ of the cross-section of the envelope surface, better 1.75 times the maximum diameter, better still 1.5 times or 1.25 times.

The angle $\alpha$ formed by the slope of the envelope surface in at least one longitudinal section on either side of the maximum may be greater than or equal to 120°, better 130°, better still 135°.

The term "diameter $d_{max}$" should be understood as meaning the transverse dimension of the envelope surface, even if the cross-section does not present an outline that is circular.

The term "total length $q_{max}$" should be understood as the total length of the envelope surface as defined by the teeth, and as measured along the longitudinal axis of the core. The angle $\alpha$ is the angle formed by the slopes of the envelope surface on either side of the maximum, as shown in FIG. 51. These slopes may be straight lines providing the best fit to the envelope surface on either side of the maximum. They may be tangential to a portion of the envelope surface adjacent to the maximum, this portion extending for example over a length as is measured along the longitudinal axis of the core that is equal to 1 mm. The slopes may also be straight lines passing through the maximum and intersecting the envelope surface at a distance from the maximum as measured along the longitudinal axis of the core that is equal to 1 mm.

Such a relatively short applicator can be used to act on the eyelashes or the eyebrows with the stem in a multitude of orientations relative to the row of eyelashes, because of the shape of the envelope surface which defines a ball or a ball-like shape.

By way of example, the multitude of orientations may comprise orientations that are spaced apart by 180° or even more, e.g. by more than 300° in one or more planes. The user can then easily select an orientation and/or a hand movement that is most appropriate for obtaining the desired makeup effect.

Where appropriate, the user may apply makeup by turning the applicator about its axis while moving it in contact with the eyelashes as though it were running along them.

The applicator may be used on its own, e.g. in order to finish off making up the eyelashes or eyebrows onto which a composition has already been applied, or after loading the application element with a composition, loading being performed either by placing the composition on the teeth or by bringing the teeth into contact with a cake of composition or by dipping the applicator into a receptacle containing the composition.

When the applicator is used in association with a receptacle having a wiper member, the shape of the applicator may lead to unequal wiping that can be used to advantage when applying makeup. For example, the zone of greatest diameter of the applicator will be more thoroughly wiped and will be better at separating and extending the eyelashes. The end zone of the applicator can be more heavily loaded with the composition and can be used, for example, to make patches, because it is possible to use the applicator in a multitude of orientations.

The applicator can make it possible to use up excess composition that is often to be found at the end of the brush as a result of the non-zero section of the wiper orifice, and that constitutes an impediment with conventional brushes.

All of the above-mentioned differences between rows of teeth may be applied to the examples where the envelope surface is generally of a ball or ball-like shape. For example, the number of rows and/or the number of teeth per row may be greater for rows of short teeth than for rows of long teeth.

The applicator may comprise at least one tooth that is not perpendicular to the core. The portion of the core carrying the teeth may be of elongate shape along the longitudinal axis of the applicator.

The core may extend along a longitudinal axis that is rectilinear or curved. When the longitudinal axis of the core is curved, its orientation may vary by less than 90°.

In embodiments, the ratio $R_1=d_{max}/d_{core}$ is greater than or equal to 2.5, better greater than or equal to 3. $d_{core}$ corresponds to the diameter of the circle in which the cross-section of the core is inscribed.

By way of example, $d_{core}$ is greater than or equal to 2 mm and less than or equal to 3 mm, e.g. $d_{core}$ less than or equal to 2.5 mm. For example $d_{max}$ may lie in the range 6 mm to 12 mm, e.g. lying in the range 8 mm to 9 mm.

The generally spherical shape of the applicator may be associated with teeth of varying length, rather than with variation in the diameter of the core supporting them, said variation being observed along the longitudinal axis of the applicator.

$d_{stem}$ designates the diameter of the stem 7, and in the examples of the invention the ratio $R_2=d_{max}/d_{stem}$ is greater than or equal to 2.5, and better greater than or equal to 3.

The core 10 may be made in such a manner that its outer surface is situated in line with the outer surface of the stem 7, once the core is in place on the stem. This makes it possible to avoid having extra thickness present between the core and the stem.

By way of example, the diameter $d_{stem}$ lies in the range 2.5 mm to 3 mm. The core may be held in a housing in the stem as a force-fit, by adhesive, and/or by die stamping the stem onto an endpiece that is made integrally with the core.

The longitudinal axis of the core need not be fully contained in line with the longitudinal axis of the stem.

Advantage should be taken of the fact that the teeth extend over a relatively short length along the longitudinal axis of the applicator to lengthen the stem and thus make the applicator easier to handle.

The relative lengthening in stem length may also serve to improve the extent to which the teeth are impregnated, since they can be moved over a greater distance inside the receptacle prior to being withdrawn therefrom. It is possible to obtain a greater proportion of teeth that are well loaded with the composition, in particular for receptacles that were not initially 100% full, as is common practice to avoid a problem of pistoning while the applicator is being withdrawn.

This can make it possible to use receptacles of relatively shallow depth, e.g. sample receptacles, without that shallow depth of the receptacle causing the applicator to be insufficiently loaded with composition. For example, it is possible to have $R_3=d_{max}/p_{receptacle}$ greater than or equal to 3.

The depth $p_{receptacle}$ of the receptacle is defined as being the distance between the top of the receptacle with no applicator, i.e. the top end of the neck when it has such a neck, and the inside surface at the bottom of the receptacle, with the distance being measured along the longitudinal axis of the receptacle.

Preferably, $R_4=d_{max}/d_f$ (where $d_f$ is the distance between the inside face of the bottom and the bottom end of the wiper member) that is likewise greater than or equal to 3.

The receptacle used may be of any kind, and in particular it may have two portions that are movable relative to each other, with one of the portions being turned relative to the other in order to increase the volume of one chamber defined inside the receptacle between the two portions and decrease the volume of another chamber, thereby causing the composition to pass between those two chambers. This passage takes place through a central portion of the receptacle in which the applicator member is housed. Such a receptacle is described for example in application EP 1 584 260.

The envelope surface may define a cross-section of outline that is circular, at least in part, e.g. having an outline that is circular over at least 180° around the core, or even completely circular, at at least one point along the length of the core, and in particular in the vicinity of the maximum 130, or over at least a fraction of the length of the core, e.g. over the entire length of the fraction of the core that carries the bristles.

The cross-section may have an aspect ratio greater than 0.7, at least in the plane where the radius $r_{max}$ is at its maximum. The envelope surface need not have any notches or outwardly concave faces, e.g. in the plane where the radius $r_{max}$ is at its maximum.

The envelope surface may define at least one radius of length that varies in non-linear manner between the proximal end of the envelope surface and the maximum, e.g. varying along a circular arc or along any other curve other than a straight line. The term "radius" is used to designate the straight line segment going from the core perpendicularly to its axis and terminating in the envelope surface.

The envelope surface may define a radius that varies in non-radial manner between the maximum and the distal end of the envelope surface, e.g. varying along a circular arc.

Beside the maximum, e.g. towards the proximal or distal end of applicator, the envelope surface need not be conical.

The slope on one side of the maximum may vary, e.g. with increasing inclination relative to the longitudinal axis on going towards the distal or proximal end.

The envelope surface may increase and then decrease over at least 180° around the core, better 270° around the core, e.g. 360° around the core.

When seen from the side, i.e. perpendicularly to the axis of the core, the envelope surface may present a profile that is rounded on either side of the maximum.

In the example of FIG. 47, the envelope surface E is a surface of revolution presenting a cross-section that varies, e.g. having two portions 123 and 126 going towards the distal end of the core 10, which portions are substantially hemispherical and joined via an edge 130 defining a maximum where the radius r, i.e. the distance between the envelope surface E and the axis X of the core 10 is the greatest for the entire envelope surface E.

The cross-section of the brush may increase and then decrease on going from the proximal end towards the distal end of the envelope surface along at least two mutually perpendicular axes X1 and X2, as shown in FIG. 47.

In the longitudinal section plane containing the axis X1 that is perpendicular to the axis X, the radius r increases, reaches the maximum $r_{max}$, and then decreases. The same applies in the longitudinal section plane containing the axis X2. The longitudinal section planes containing the respective axes X1 and X2 may be planes of symmetry for the envelope surface.

The distance j between the transverse plane containing the edge 130 and the maximum and the distal end of the envelope surface may be about 5 mm, for example.

The angle $\alpha$ formed between the slopes 140 and 141 of the envelope surface, and situated respectively on either side of the edge at the maximum 130 may be considerably greater than 120°, as can be seen in FIG. 51.

As shown in FIG. 51, each slope 140 or 141 is defined by the straight line passing through the maximum of the envelope surface E and fitting as closely as possible to the outline of the envelope surface in a longitudinal section plane over a distance of 1 mm along the axis X, on the corresponding side of the maximum.

In the example of a biconical envelope surface, the slopes are respectively the slopes of the two conical portions. In the example of an envelope surface that is spherical, being symmetrical about the plane containing the maximum 130, the angle $\alpha$ is closer to 180°.

In the example of FIG. 47, the aspect ratio of the brush in the transverse plane containing the edge at the maximum 130 is equal to 1, the envelope surface E presenting a circular outline centered on the axis X of the core 10.

The aspect ratio is defined by $r_{min}/r_{max}$, where $r_{max}$ designates the maximum ratio in the cross-section under consideration, i.e. the greatest distance from the axis X of the core 10 to the envelope surface E, and where $r_{min}$ designates the minimum radius, i.e. the shortest distance from the axis X of the core 10 to the envelope surface E in the section plane.

Figure 52:
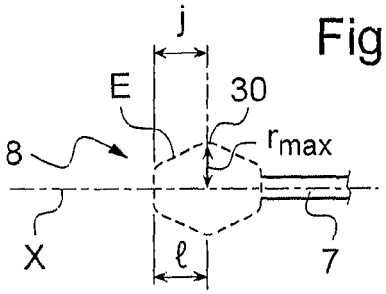

In the example of FIG. 52, the envelope surface is substantially biconical in shape.

The angle α between the slopes at the maximum is nevertheless relatively large, in particular greater than 120°, so as to approximate to the shape of a ball.

The radius r need not decrease down to zero at the ends of the envelope surface.

Whether in this example or in others, the diameter of the envelope surface E at the distal end may be greater than or equal to 4 mm, for example.

Where appropriate, the envelope surface E may be symmetrical on either side of a midplane containing the maximum 130.

Figure 53:
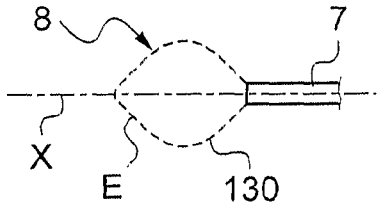

In the example of FIG. 53, the envelope surface E presents a shape in longitudinal section that is generally lenticular. The cross-section defined by the envelope surface E increases for example from a proximal end where the radius r is substantially zero up to the maximum 130, and then decreases to an end where the radius r may again be substantially zero.

The maximum 130 may be defined by an edge, as shown in the above examples. In a variant, the maximum 130 may extend over a certain distance along the axis X, as shown in FIG. 54.

In the example of this figure, the envelope surface E defines a maximum cross-section of radius $r_{max}$ over a distance t prior to decreasing going towards the free end of the core. The middle of this portion of radius $r_{max}$ is situated, by way of example, at a distance l from the free end which is such that the ratio $l/r_{max}$ is less than 1.5. The length t may be greater than or equal to 1 mm, for example.

The envelope surface E, in particular in the plane where the cross-section is at its maximum, may present a shape that is not a surface of revolution.

For example, in a longitudinal section plane over its portion where the cross-section varies, the envelope surface may present an outline that is substantially semicircular on one side of the core and substantially triangular on the other side of the core, as shown in FIG. 55.

By way of example, the maximum radius $r_{max}$ may be defined by the substantially semicircular portion or by the substantially triangular portion.

In certain embodiments, the envelope surface may be spherical to within 20%, at least over its portion extending from a plane where the transverse dimension defined by the envelope surface E is at a maximum, all the way to the distal end.

As shown in FIGS. 49 to 50, the applicator may have teeth that point towards the proximal end of the applicator.

The applicator may comprise teeth that extend in more than four directions around the axis of the core, better that extend in at least eight directions around the axis X of the core, and in particular in more than eight directions.

As shown in FIGS. 48 to 50, the core 10 and the envelope surface E may both pass through a respective maximum cross-section at the same axial position along the axis X.

The teeth may present a height that varies such that their free ends define the profile desired for the envelope surface E. By way of example the core 10 may be elongate in shape, e.g. cylindrical, and the envelope surface may be generally ball-shaped.

By way of example, the radius r of the envelope surface E may vary by less than 50% between one-fourth and one-half of the distance between the plane containing the maximum 130 and the distal end of the applicator.

When the applicator is loaded with composition by being inserted into a receptacle through a wiper member, the teeth of the applicator may bend towards the distal end while the applicator is being withdrawn in certain embodiments. Some of the teeth may be long enough and close enough to the distal end for them, on bending, to cover the shorter teeth situated closer to the distal end. While bending on passing through the wiper member, the free ends of some of the teeth may come substantially level with the distal end of the core along the axis X.

In other aspects of the invention, the applicator may have an envelope surface with any one of the following characteristics;

The envelope surface (E) defined by the teeth may increase and then decrease going towards the distal end of the applicator.

The envelope surface may present a distal portion that is at least partially spherical or hemispherical to within 20%.

The total length $q_{max}$ along the longitudinal axis of the envelope surface (E) may be less than or equal to twice the greatest diameter $d_{max}$ of the cross-section of the envelope surface.

The total length $q_{max}$ may verify $q_{max} \leq 1.75\ d_{max}$, preferably with $q_{max} \leq 1.5\ d_{max}$, better with $q_{max} \leq 1.25\ d_{max}$.

The angle α formed by the slopes of the envelope surface at least in a longitudinal section on either side of a maximum of the envelope surface may be greater than 120°.

The envelope surface may have an aspect ratio ($r_{min}/r_{max}$) greater than 0.7, at least in the transverse plane including the maximum 130.

The greatest radius $r_{max}$ measured at the maximum 130 may be greater than or equal to 3 mm.

The distance (l) from the transverse plane containing the maximum 130 to the distal end of the applicator may be less than or equal to 12 mm.

The maximum 130 may be situated at a distance ($r_{max}$) lying in the range 2.5 mm to 2.75 mm from the axis (X) of the core 10.

The ratio $R_1 = d_{max}/d_{core}$ may be greater than or equal to 2.5, where $d_{core}$ corresponds to the diameter of the circle in which the cross-section of the core is inscribed.

The ratio $R_2 = d_{max}/d_{stem}$ may be greater than or equal to 2.5, where $d_{stem}$ corresponds to the maximum diameter of the stem.

Such an applicator may also present at least one of the characteristics of the applicators described with reference to the figures of the present application. In the variant embodiment shown in FIG. 58, the core comprises a recess in which there is engaged a support portion 60, e.g. made of metal or plastics material. The core may be configured to be fastened to the support 60, or it may be free to turn or to move in translation relative to the support 60.

The teeth of at least one row could present different heights, passing through an extremum between the extreme teeth of the row, for example.

At least one of the teeth 18 of the rows 17 could present a surface state that is not smooth, e.g. having ridges as a result of molding or roughness linked to the presence of a filler in the plastics material, for example.

The applicator member could be made with a plastics material that comprises magnetic particles. The magnetic field created by such particles, that could be magnetizable and/or magnetized, could, for example, exert an effect on the eyelashes and/or interact with magnetic fibers or pigments that are present in the composition.

The applicator member could be made with flocking, said flocking extending over the teeth only, for example.

At their free ends, the teeth could present respective portions in relief or a particular shape, e.g. a fork, a hook, or a bead, as shown in FIGS. 59 to 61. By way of example, the hook could extend transversally, parallel, or obliquely relative to the longitudinal axis X of the core.

In order to obtain the bead, it is possible to heat the applicator member in such a manner as to melt the end of the teeth, for example. In order to obtain the forks or the hooks, it is possible to abrade the applicator member, for example.

The rows 17 could comprise different numbers of teeth, with one of the rows being shorter than another, for example.

All of the teeth could be connected to the core along a direction that is contained in a plane that is perpendicular to the axis X. This could be otherwise, and teeth could slope towards the distal or proximal end.

The wiper member could be made in some other way, e.g. it could comprise a block of foam that could be slotted. The wiper member could be as described in patent applications or U.S. Pat. Nos. 2005/0028834, 2005/0175394, 2004/0258453, 6,375,374, 6,328,495, for example.

The wiper lip 9 could advantageously be undulating, having a radially-inner free edge defining an orifice 122 through which the applicator member can pass, as shown in FIG. 62. The wiper lip 9 could comprise undulations 120 that extend around the orifice 122. The wiper member 9 may comprise a number of undulations 120 lying in the range 3 to 12, for example.

The wiper lip 9 could extend generally along a cone that converges towards the bottom of the receptacle, and that has a generator line G forming an angle i with the axis X of the receptacle. In a variant, the wiper lip 9 could extend generally along a mid-plane that is perpendicular to the axis X, or it could even extend generally along a cone that converges towards the outlet of the receptacle.

The wiper member could also be adjustable, where appropriate.

The stem 7 to which the core is fastened could be flexible at least in part, and in particular could be entirely flexible, in particular in the proximity of the applicator member. By way of example, the stem could comprise at least one flexible element 80, as shown in FIG. 63, or at least one elastomer element, for example, or it could present a shape that imparts flexibility, e.g. at least one notch 81 as shown in FIG. 64. By way of example, the flexible or elastomer element could be flocked and/or could also be used for applying the composition.

In order to use the device 1, the user can unscrew the closure cap 5 and remove the applicator member 8 from the receptacle 3.

After the applicator member 8 has passed through the wiper member 6, a certain quantity of composition remains between the rows 17 and between the teeth 18 of the rows, and can be applied to the eyelashes or the eyebrows by the user.

The relatively large number of teeth and their disposition on the applicator member make it possible to apply makeup neatly.

The wiping movement used to apply makeup to the eyelashes or the eyebrows can possibly be accompanied by the applicator member being turned about the axis X. The obliquely-oriented teeth can be directed towards the eyelashes when applying makeup.

Still in a variant, vibration could be applied to the applicator member during application, combing, or while taking the composition, e.g. as described in application WO 2006/090343.

Naturally, the invention is not limited to the above-described embodiments, the characteristics of which may be combined together within variants not shown.

The term "comprising a" should be understood as being synonymous with the term "comprising at least one" unless specified to the contrary.

The expression "lying in the range" should be construed as comprising the limits of the range, unless specified to the contrary.

The invention claimed is:

1. An applicator for combing eyelashes and/or eyebrows and/or for applying a composition thereto, the applicator comprising a molded applicator member, comprising:

an elongate core in thermoplastic material, the elongate core having a longitudinal axis; and at least three rows of teeth that are connected to the core, the rows extending along a rectilinear axis being parallel to the longitudinal axis of the core, having at least one row of long teeth and at least one row of short teeth, the rows of teeth being distributed around the longitudinal axis of the core with constant angular spacing between a longitudinal axis of the rows, measured over a surface of the core, over at least a fraction of the length of the applicator member, wherein at least one row of long teeth is disposed on the core in a manner that is different from a row of short teeth, the two rows differing in at least one of the following features: a spacing of the teeth in the row; a number of teeth in the row; and a thickness of the teeth measured perpendicularly to their longitudinal direction.

2. An applicator for combing eyelashes and/or eyebrows and/or for applying a composition thereto, the applicator comprising a molded applicator member, comprising:

an elongate core having a longitudinal axis; and at least three rows of teeth that are connected to the core, the teeth being molded integrally with the core, the rows extending along a rectilinear axis being parallel to the longitudinal axis of the core, having at least one row of long teeth and at least one row of short teeth, with rows of teeth being disposed in at least one group of close-together rows, a longitudinal axis of the groups of rows being disposed around the core with constant spacing measured along a surface of the core over at least a fraction of the length of the applicator member, and the teeth of the group of close-together rows being parallel to one another within the group.

3. An applicator according to claim 1, wherein at least one row of long teeth is disposed on the core in a manner that is different from a row of short teeth, the two rows differing in at least one of the following ways: a spacing of the teeth in the row; a number of teeth in the row; and a thickness of the teeth measured perpendicularly to their longitudinal direction.

4. An applicator according to claim 1, wherein the majority of teeth of the rows of short teeth are spaced apart at a first spacing along the row, and the majority of teeth of the rows of long teeth are spaced apart at a second spacing, the first spacing being different from the second spacing.

5. An applicator according to claim 1, wherein the majority of teeth of the rows of short teeth have thickness that is smaller than the thickness of the majority of teeth of the rows of long teeth.

6. An applicator according to claim 1, wherein the number of teeth in at least one row of short teeth is greater than the number of teeth in at least one row of long teeth.

7. An applicator according to claim 1, the rows of long teeth comprising at least two rows.

8. An applicator according to claim 1, the rows of long teeth comprising at least two sets of rows of teeth, the rows of long teeth of a set following one another around the longitudinal axis, and the two sets of rows of long teeth being separated around the longitudinal axis by at least one row of short teeth.

9. An applicator according to claim 1, wherein a row of long teeth follow a row of short teeth around the longitudinal axis.

10. An applicator according to claim 1, wherein the teeth in the rows of short teeth have a maximum length, measured from the core, that is less than or equal to 1.8 mm.

11. An applicator according to claim 1, wherein the teeth in the rows of long teeth have a length, measured from the core, lying in the range 1.35 mm to 3.4 mm.

12. An applicator according to claim 1, wherein at least two successive teeth of a row are touching at their bases.

13. An applicator according to claim 1, wherein each of two consecutive teeth of a row extends along a relative direction from the core, the two directions forming a non-zero angle between them.

14. An applicator according to claim 1, wherein at least one row of teeth comprises a succession of teeth that extend alternately on opposite sides of a separation surface.

15. An applicator according to claim 1, wherein at least one tooth has at least one plane face that is parallel to its longitudinal direction.

16. An applicator according to claim 1, wherein the teeth of the rows of long teeth are connected to the core by occupying a first angular extent, with the teeth of the rows of short teeth being connected to the core by occupying a second angular extent that is different from the first.

17. An applicator according to claim 1, wherein the teeth of the rows of long teeth are connected to the core by occupying a first angular extent, with the teeth of the rows of short teeth being connected to the core by occupying a second angular extent that is equal to the first.

18. An applicator according to claim 1, wherein at least one row of long teeth differs from a row of short teeth in one of the following ways: an implantation of the teeth in the row; a material forming the teeth; a shape of the teeth; and a shape of a cross-section of the teeth.

19. An applicator according to claim 1, wherein the teeth of the rows of short teeth and the teeth of the rows of long teeth are not disposed within their rows in the same manner relative to the core.

20. An applicator according to claim 10, wherein the difference between the length of the short teeth and the length of the long teeth is at least 0.3 MM.

21. An applicator according to claim 1, wherein the difference between a length of the long teeth and a length of the short teeth is in the range 20% to 50%.

22. An applicator according to claim 1, wherein the ends of the teeth of the rows of short teeth define a first surface of greatest transverse dimension that is less than 5.5 mm.

23. An applicator according to claim 1, wherein the ends of the teeth of the rows of long teeth define a second surface of greatest transverse dimension in the range 5.7 mm to 10 mm.

24. An applicator according to claim 1, wherein more than half of the teeth of the applicator member belong to the rows of short teeth.

25. An applicator according to claim 1, wherein less than half of the teeth of the applicator member belong to the rows of long teeth.

26. An applicator according to claim 1, wherein the teeth of the rows of short teeth and the teeth of the rows of long teeth are made out of the same material.

27. An applicator according to claim 1, wherein the teeth of the rows of short teeth and the teeth of the rows of long teeth are made out of different materials.

28. An applicator according to claim 1, wherein at least two successive teeth of a row are non-touching at their bases.

29. An applicator according to claim 1, wherein when the applicator is observed perpendicularly to its longitudinal axis, at least two consecutive teeth of a row define a V-shaped groove.

30. An applicator according to claim 1, wherein teeth of one row and teeth of another row extend in different directions.

31. An applicator according to claim 1, wherein the teeth of at least one row have bases that are substantially in alignment.

32. An applicator according to claim 1, wherein at least one tooth presents a cross-section that is circular, semi-circular, semi-elliptical, polygonal, triangular, square, rectangular, octagonal, parallelogram-shaped, lozenge-shaped, or oval.

33. An applicator according to claim 1, wherein at least one tooth presents at least one portion in relief.

34. An applicator according to claim 1, wherein the longitudinal axis of the core is rectilinear.

35. An applicator according to claim 1, wherein the longitudinal axis of the core is curved.

36. An applicator according to claim 1, wherein the core comprises a recess in which there is engaged a support portion.

37. An applicator according to claim 1, wherein the portion of the core that supports the teeth is solid.

38. An applicator according to claim 1, wherein over at least a fraction of its length, the core presents a cross-section that is: circular; polygonal;

triangular; square; rectangular; pentagonal; hexagonal; octagonal; or oval.

39. An applicator according to claim 1, wherein the core has a cross-section that passes via a minimum along the longitudinal axis of the core.

40. An applicator according to any preceding claim 1, wherein the core comprises at least one face from which teeth extend, the face presenting a width that varies along the longitudinal axis of the core.

41. An applicator according to claim 1, wherein at least one of the core and a tooth is flocked.

42. An applicator according to claim 1, wherein at least one of the core and a tooth has magnetic properties.

43. An applicator according to claim 1, comprising a stem, the applicator member extending from a first end of the stem.

44. An applicator according to claim 43, wherein the stem is connected to a handle at a second end of the stem remote from the first end of the stem.

45. An applicator according to claim 1, wherein not all of the teeth of the rows of teeth have longitudinal directions that are parallel to each other.

46. An applicator according to claim 1, comprising more than six rows or groups of close-together rows.

47. An applicator according to claim 1, comprising only single rows of the short teeth or the long teeth.

48. An applicator according to claim 1, comprising only groups of close-together rows.

49. A packaging and applicator device for applying a cosmetic or a care product to eyelashes and/or eyebrows, the device comprising an applicator as defined in claim 1, and a receptacle containing a composition for application to the eyelashes and/or the eyebrows.

50. A device according to claim 49, wherein the applicator comprises a handle, and wherein the handle of the applicator constitutes a closure cap for closing the receptacle.

51. A device according to claim 49, comprising a wiper member for wiping the applicator member.

* * * * *